US009646551B2

(12) United States Patent
Fujioka et al.

(10) Patent No.: US 9,646,551 B2
(45) Date of Patent: May 9, 2017

(54) DISPLAY CONTROL SYSTEM, PROCESSOR, CONTROLLER, AND DISPLAY CONTROL METHOD

(71) Applicant: Sharp Kabushiki Kaisha, Osaka-shi, Osaka (JP)

(72) Inventors: Akizumi Fujioka, Osaka (JP); Atsushi Sakamoto, Osaka (JP); Kazuo Nakamura, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 247 days.

(21) Appl. No.: 14/429,987

(22) PCT Filed: Aug. 7, 2013

(86) PCT No.: PCT/JP2013/071406
§ 371 (c)(1),
(2) Date: Jul. 15, 2015

(87) PCT Pub. No.: WO2014/045749
PCT Pub. Date: Mar. 27, 2014

(65) Prior Publication Data

US 2015/0317938 A1 Nov. 5, 2015

(30) Foreign Application Priority Data

Sep. 21, 2012 (JP) ..... 2012-208941

(51) Int. Cl.
*G09G 5/00* (2006.01)
*G09G 3/36* (2006.01)
*G09G 3/20* (2006.01)

(52) U.S. Cl.
CPC ..... *G09G 3/3614* (2013.01); *G09G 3/2092* (2013.01); *G09G 3/3648* (2013.01);
(Continued)

(58) Field of Classification Search
CPC ..... G09G 3/36; G09G 3/20; G09G 3/2092; G09G 3/3614; G09G 3/3648;
(Continued)

(56) References Cited

U.S. PATENT DOCUMENTS 7,002,541 B2 * 2/2006 Yanagi ..... G09G 3/3648 345/92
7,605,794 B2 * 10/2009 Nurmi ..... G09G 3/3406 345/102

(Continued)

FOREIGN PATENT DOCUMENTS

JP 2002-207462 A 7/2002
JP 2002-278523 A 9/2002

(Continued)

*Primary Examiner* — Vijay Shankar
(74) *Attorney, Agent, or Firm* — Keating & Bennett, LLP

(57) ABSTRACT

A processor determines a drive scheme from among candidates of a plurality of drive schemes having differing schemes for supplying a signal to a signal line of a display panel. A controller stores a scheme drive information in which a drive scheme information and a signal control information in a drive scheme are associated. A controller receives a scheme information from a processor, and controls a signal supplied to a signal line of a display panel, the control being made based on a scheme information and a scheme drive information.

13 Claims, 27 Drawing Sheets

(52) U.S. Cl.
CPC ..... *G09G 3/3666* (2013.01); *G09G 2330/021* (2013.01); *G09G 2340/0435* (2013.01); *G09G 2370/042* (2013.01)

(58) Field of Classification Search
CPC ..... G09G 3/3666; G09G 2330/021; G09G 2370/042; G09G 2340/0435
USPC ..... 345/87–98, 204–215
See application file for complete search history.

(56) References Cited

U.S. PATENT DOCUMENTS

| | | | | |
|---|---|---|---|---|
| 7,843,533 | B2 * | 11/2010 | Noguchi | G09G 3/3614 349/114 |
| 8,026,887 | B2 * | 9/2011 | Koo | G09G 3/3614 345/209 |
| 2002/0093473 | A1 | 7/2002 | Tanaka et al. | |
| 2009/0295786 | A1 | 12/2009 | Ito et al. | |
| 2012/0113170 | A1 | 5/2012 | Igarashi | |

FOREIGN PATENT DOCUMENTS

| | | | |
|---|---|---|---|
| JP | 2009-288789 | A | 12/2009 |
| JP | 2010-245118 | A | 10/2010 |
| JP | 2011-30081 | A | 2/2011 |
| TW | 594125 | B | 6/2004 |

* cited by examiner

FIG. 6

| EDID | REFRESHING TYPE | DRIVE MODE | VARIABLE | ... |
|---|---|---|---|---|
| AAA | EXIT | 1 (NORMAL DRIVE) | – | ... |
| | | 2 (AUTO-STOPPED DRIVE) | – | ... |
| | | 3 (STOPPED DRIVE 1 FREQUENCY SELECTION) | R FREQUENCY (5 TO 60 Hz) | ... |
| | | 4 (STOPPED DRIVE 2 PARTIAL DRIVE) | DISPLAY REGION, R FREQUENCY (5 TO 60 Hz) | ... |
| | | 5 (OVERDRIVE DRIVE) | – | ... |
| | ENTER | 6 (SELF-STOPPED DRIVE 1 FREQUENCY SELECTION) | R FREQUENCY (5 TO 60 Hz) | ... |
| BBB | EXIT | 1 (NORMAL DRIVE) | R FREQUENCY (40 TO 60 Hz) | ... |
| | | 3 (OVERDRIVE DRIVE) | – | ... |
| | ENTER | 7 (SELF-STOPPED DRIVE 2 FREQUENCY SELECTION 2) | – | ... |
| ... | ... | ... | ... | ... |

FIG. 10

| DRIVE MODE | REFRESHING TYPE | R FREQUENCY | APPLIED VOLTAGE | ··· |
|---|---|---|---|---|
| 1 (NORMAL DRIVE) | EXIT | 60Hz | V1 | ··· |
| 2 (AUTO-STOPPED DRIVE) | EXIT | 5Hz | V1 | ··· |
| 3 (STOPPED DRIVE 1 FREQUENCY SELECTION) | EXIT | INPUT VALUE (5 TO 60 Hz) | V1 | ··· |
| 4 (STOPPED DRIVE 2 PARTIAL DRIVE) | EXIT | INPUT VALUE (5 TO 60 Hz) | V1 (R FREQUENCY = 60 Hz) | ··· |
| | | | Va (40 Hz ≦ R FREQUENCY < 60 Hz) | ··· |
| | | | Vb (5 Hz ≦ R FREQUENCY < 40 Hz) | ··· |
| 5 (OVERDRIVE DRIVE) | EXIT | 60Hz | V2 | ··· |
| 6 (SELF-STOPPED DRIVE 1 FREQUENCY SELECTION) | ENTER | INPUT VALUE (5 TO 60 Hz) | V1 | ··· |
| 7 (SELF-STOPPED DRIVE 2 FREQUENCY SELECTION 2) | ENTER | INPUT VALUE (40 TO 60 Hz) | V1 | ··· |

FIG. 15

| CONTENTS | DRIVE MODE | CHANGE CONDITIONS | DRIVE MODE AFTER CHANGE |
|---|---|---|---|
| VIDEO | 1 (NORMAL DRIVE) | | |
| STILL IMAGE, TEXT, WEB, ELECTRONIC BOOK, | 2 (AUTO-STOPPED DRIVE) | USER INPUT | 1 (NORMAL DRIVE) |
| | 3 (STOPPED DRIVE 1 FREQUENCY SELECTION) | | |
| | 6 (SELF-STOPPED DRIVE 1 FREQUENCY SELECTION) | USER INPUT | 1 (NORMAL DRIVE) |
| | | | 3 (STOPPED DRIVE 1 FREQUENCY SELECTION) |
| PARTIAL VIDEO | 4 (STOPPED DRIVE 2 PARTIAL DRIVE) | | |
| VIDEO (SPORTS), GAMES | 5 (OVERDRIVE DRIVE) | | |
| | | | |

FIG. 17

| CONTENTS | DRIVE MODE | CHANGE CONDITIONS | DRIVE MODE AFTER CHANGE |
|---|---|---|---|
| DOCUMENT EDITING OR OTHER | 1 (NORMAL DRIVE) | | |
| WEB BROWSER, ELECTRONIC BOOK, STILL IMAGE DISPLAY, DOCUMENT DISPLAY | 2 (AUTO-STOPPED DRIVE) | USER INPUT | 1 (NORMAL DRIVE) |
| | 3 (STOPPED DRIVE 1 FREQUENCY SELECTION) | | |
| | 6 (SELF-STOPPED DRIVE 1 FREQUENCY SELECTION) | USER INPUT | 1 (NORMAL DRIVE) |
| | | | 3 (STOPPED DRIVE 1 FREQUENCY SELECTION) |
| PARTIAL VIDEO PLAYBACK | 4 (STOPPED DRIVE 2 PARTIAL DRIVE) | | |
| VIDEO PLAYBACK, GAMES | 5 (OVERDRIVE DRIVE) | | |
| | | | |

FIG. 20

| EDID | SECOND DRIVE MODE | VARIABLE | ··· |
|---|---|---|---|
| AAA | 111 (FRAME REVERSAL DRIVE 2) | – | ··· |
| | 121 (HORIZONTAL LINE REVERSAL DRIVE 2) | – | ··· |
| | 131 (VERTICAL LINE REVERSAL DRIVE 2) | – | ··· |
| | 141 (DOT REVERSAL DRIVE 2) | – | ··· |
| | 151 (2-DOT REVERSAL DRIVE 2) | – | |
| | 161 (8-DOT REVERSAL DRIVE 2) | – | |
| | 112 (FRAME REVERSAL DRIVE 3) | R FREQUENCY | ··· |
| | 122 (HORIZONTAL LINE REVERSAL DRIVE 3) | R FREQUENCY | ··· |
| | 132 (VERTICAL LINE REVERSAL DRIVE 3) | R FREQUENCY | ··· |
| | 142 (DOT REVERSAL DRIVE 3) | R FREQUENCY | |
| | 152 (DOT REVERSAL DRIVE 4) | DOT INTERVAL, R FREQUENCY | ··· |
| BBB | 110 (FRAME REVERSAL DRIVE 1) | – | ··· |
| | 120 (HORIZONTAL LINE REVERSAL DRIVE 1) | – | ··· |
| | 130 (VERTICAL LINE REVERSAL DRIVE 1) | – | |
| | 140 (DOT REVERSAL DRIVE 1) | – | ··· |
| ··· | ··· | ··· | ··· |

FIG. 22

| SECOND DRIVE MODE | FREQUENCY | REVERSAL INTERVAL | ··· |
|---|---|---|---|
| 110 (FRAME REVERSAL DRIVE 1) | 60Hz | – | ··· |
| 120 (HORIZONTAL LINE REVERSAL DRIVE 1) | 60Hz | – | ··· |
| 130 (VERTICAL LINE REVERSAL DRIVE 1) | 60Hz | – | ··· |
| 140 (DOT REVERSAL DRIVE 1) | 60Hz | 1 DOT | ··· |
| 111 (FRAME REVERSAL DRIVE 2) | R11 | – | ··· |
| 121 (HORIZONTAL LINE REVERSAL DRIVE 2) | R12 | – | ··· |
| 131 (VERTICAL LINE REVERSAL DRIVE 2) | R13 | – | ··· |
| 141 (DOT REVERSAL DRIVE 2) | R14 | 1 DOT | ··· |
| 151 (2-DOT REVERSAL DRIVE 2) | R15 | 2 DOTS | ··· |
| 161 (8-DOT REVERSAL DRIVE 2) | R16 | 8 DOTS | ··· |
| 112 (FRAME REVERSAL DRIVE 3) | INPUT VALUE | – | ··· |
| 122 (HORIZONTAL LINE REVERSAL DRIVE 3) | INPUT VALUE | – | ··· |
| 132 (VERTICAL LINE REVERSAL DRIVE 3) | INPUT VALUE | – | ··· |
| 142 (DOT REVERSAL DRIVE 3) | INPUT VALUE | 1 DOT | ··· |
| 152 (DOT REVERSAL DRIVE 4) | INPUT VALUE | INPUT VALUE | ··· |
| ··· | ··· | ··· | ··· |

| EDID | THIRD DRIVE MODE | VARIABLE | ... |
|---|---|---|---|
| AAA | 210 (NORMAL RESOLUTION DRIVE) | | ... |
| | 220 (MULTIPLIED RESOLUTION DRIVE) | | ... |
| | 240 (N-MULTIPLIED RESOLUTION DRIVE) | N | |
| | 250 (HALF-RESOLUTION DRIVE) | | |
| | 260 (1/N-RESOLUTION DRIVE) | N | ... |
| BBB | ... | | ... |
| ... | ... | | ... |

| THIRD DRIVE MODE | CHANGE MULTIPLIER | ··· |
|---|---|---|
| 210 (NORMAL RESOLUTION DRIVE) | 1 | ··· |
| 220 (MULTIPLIED RESOLUTION DRIVE) | 2 | ··· |
| 240 (N-MULTIPLIED RESOLUTION DRIVE) | INPUT VALUE | ··· |
| 250 (HALF-RESOLUTION DRIVE) | 1/2 | ··· |
| 260 (1/N-RESOLUTION DRIVE) | 1/INPUT VALUE | ··· |
| ··· | ··· | ··· |

FIG. 29

| DISPLAY REGION IDENTIFICATION INFORMATION | DISPLAY REGION INFORMATION | R FREQUENCY RANGE |
|---|---|---|
| 1 | A1 TO A2, B1 TO B2 | 5 Hz TO 60 Hz |
| 2 | A2 TO A3, B2 TO B3 | 30 Hz TO 60 Hz |
| 3 | A3 TO A4, B3 TO B4 | 5 Hz TO 60 Hz |

DISPLAY CONTROL SYSTEM, PROCESSOR, CONTROLLER, AND DISPLAY CONTROL METHOD

TECHNICAL FIELD

The present invention relates to a display control system, a processor, a controller, and a display control method.

The subject application claims priority based on the patent application No. 2012-208941 filed in Japan on Sep. 21, 2012 and incorporates by reference herein the contents thereof.

BACKGROUND ART

In recent years, development of technologies related to displays in display devices such as television devices, computers, mobile telephone handsets, music players, digital cameras, and tablet terminals has been progressing.

For example, Patent Document 1 describes the reduction of the power consumption of a liquid crystal display element when displaying a still image by, at the end of a frame, holding the scanning potential $V_g$ and the signal potential $V_{sig}$ at fixed potentials before transitioning to the next frame and providing a drive stopping period in which the drive circuit is stopped.

Patent Document 2 describes a liquid crystal display module drive circuit in which, in a first operating mode, all the liquid crystal cells are repeatedly recharged at a low refresh rate and, in a second operating mode, all the liquid crystal cells are repeatedly recharged at a normal refresh rate that is higher than the low refresh rate.

PRIOR ART DOCUMENTS

Patent Documents

[Patent Document 1] Japanese Patent Application Publication No. 2002-207462

[Patent Document 2] Japanese Patent Application Publication No. 2009-288789

[Patent Document 3] Japanese Patent Application Publication No. 2010-245118

SUMMARY OF THE INVENTION

Problem to Be Solved by the Invention

In Patent Document 3, there is a description of when forming semiconductor layers 13 and 17 of a TFT substrate 1 having thin-film transistors 5 and a supplementary capacitance 6, using IGZO, which has indium, gallium, zinc, and oxygen as its main components. Because the electron mobility in a display device using IGZO is high, it is expected that a new drive scheme will make use of that characteristic. Thus, a variety of drive schemes are expected to be adopted in display devices.

However, in the art described in Patent Document 1, there is only one drive scheme, which provides a drive stopping period. Therefore, even if there is another appropriate drive scheme, it is not possible to change the drive scheme, leading to the drawback of not being able to drive the display device using an appropriate drive scheme.

Also, with the art described in Patent Document 2, the two drive schemes of the low refresh rate and the normal refresh rate are switched by a drive circuit for the liquid crystal display module. For this reason, for example, when the drive scheme switching conditions are changed, it is necessary to update firmware in the liquid crystal display module drive circuit, and this change is difficult. As a result, with the art of Patent Document 2 there is a drawback of not being able to drive a display device by an appropriate drive scheme.

The present invention is made in consideration of the above-noted points and has as an object the provision of a display control system, a processor, a controller, and a display control method capable of driving a display device by an appropriate drive scheme.

Means to Solve the Problem (1) The present invention is made to solve the above-described problem, and one aspect of the present invention is a display control system including a processor and a controller, wherein the processor includes: a scheme determination unit that determines a drive scheme from among candidates of a plurality of drive schemes having differing schemes for supplying a signal to a signal line of a display unit; and a scheme information transmitting unit that transmits a scheme information indicating a drive scheme determined by the scheme determination unit, and wherein the controller includes: a scheme drive information storage unit that stores a scheme drive information in which the drive scheme information and a signal control information in the drive scheme are associated; a scheme information acquisition unit that receives a scheme information from the processor; and a signal control unit that controls a signal supplied to a signal line of the display unit, the control being made based on a scheme information received by the scheme information acquisition unit and based on a scheme drive information.

(2) In addition, one aspect of the present invention is the above-described display control system, wherein at least two of the drive schemes differ in a frequency of refreshing a display.

(3) In addition, one aspect of the present invention is the above-described display control system, wherein at least one of the drive schemes differ in a frequency of refreshing a display in two display regions among a plurality of display regions.

(4) In addition, one aspect of the present invention is the above-described display control system, wherein at least two of the drive schemes differ in a reference value of a voltage of a signal supplied to a signal line of the display unit.

(5) In addition, one aspect of the present invention is the above-described display control system, wherein the drive scheme is an alternating current drive scheme in which a polarity of a voltage applied to a liquid crystal is changed in a time direction.

(6) In addition, one aspect of the present invention is the above-described display control system, wherein the drive scheme is a polarity reversal drive scheme that changes a polarity of a voltage applied to a liquid crystal within a screen.

(7) In addition, one aspect of the present invention is the above-described display control system, wherein the controller includes: an image data acquisition unit that acquires an image data from outside; and an image data storage unit that stores at least one frame of an image data acquired by the image data acquisition unit, wherein a signal control unit controls a first acquisition scheme that controls a signal supplied to a signal line of the display unit, based on an image data of a second frame acquired by the image data acquisition unit in a second frame that follows next after a first frame, or a second acquisition scheme that controls a signal supplied to a signal line of the display unit, based on an image data of a first frame stored by the image data storage unit, and wherein the scheme determination unit determines a drive scheme from among candidates of a plurality of drive schemes having differing display refreshing frequencies in a case that the first acquisition scheme is selected.

(8) In addition, one aspect of the present invention is the above-described display control system, wherein the scheme determination unit determines a variable corresponding to a determined drive scheme, and wherein the scheme information transmitting unit transmits a scheme information indicating a drive scheme and a variable that are determined by the scheme determination unit.

(9) In addition, one aspect of the present invention is the above-described display control system, wherein the scheme determination unit determines a variable representing a frequency of refreshing a display.

(10) In addition, one aspect of the present invention is the above-described display control system, wherein the controller includes: an image data acquisition unit that acquires an image data from outside; and an image data storage unit that stores at least one frame of an image data acquired by the image data acquisition unit, wherein a signal control unit controls a first acquisition scheme that controls a signal supplied to a signal line of the display unit, based on an image data of a second frame acquired by the image data acquisition unit in a second frame that follows next after a first frame, or a second acquisition scheme that controls a signal supplied to a signal line of the display unit, based on an image data of a first frame stored by an image data storage unit, and wherein the scheme determination unit determines a variable representing a frequency of refreshing a display in a case that the first acquisition scheme is selected.

(11) In addition, one aspect of the present invention is the above-described display control system, wherein the scheme information transmitting unit transmits a scheme information that includes a pre-established identification information, and wherein, upon detecting that the identification information is included in a scheme information received by the scheme information acquisition unit, the signal control unit controls a signal supplied to a signal line of the display unit, based on the scheme information and the scheme drive information.

(12) In addition, one aspect of the present invention is the above-described display control system, wherein the identification information is an information included in an EDID (extended display identification data).

(13) In addition, one aspect of the present invention is the above-described display control system, wherein the processor and the controller use a main link that transfers an image data and an auxiliary channel having a slower transfer rate than that of a main link to perform communication, the scheme information transmitting unit transmits the scheme information using the auxiliary channel, and the scheme information acquisition unit receives the scheme information using the auxiliary channel.

(14) In addition, one aspect of the present invention is the above-described display control system, wherein the processor includes: an image data generation unit that generates an image data, and wherein the scheme determination unit determines a drive scheme, based on an image data generated by an image data generation unit.

(15) In addition, one aspect of the present invention is a processor including: a scheme determination unit that determines a drive scheme from among candidates of a plurality of drive schemes having differing schemes for supplying a signal to a signal line of a display unit; and a scheme information transmitting unit that transmits a scheme information indicating a drive scheme determined by the scheme determination unit.

(16) In addition, one aspect of the present invention is a controller including: a scheme drive information storage unit that stores a scheme drive information in which a plurality of drive schemes having differing schemes of supplying a signal to a signal line of a display unit and a signal control information in the drive scheme in each of the plurality of drive schemes are associated; a scheme information acquisition unit that receives a scheme information indicating the drive scheme; and a signal control unit that controls a signal supplied to a signal line of the display unit, based on a scheme information received by the scheme information acquisition unit and based on the scheme drive information.

(17) In addition, one aspect of the present invention is a display control method including: a scheme determination step of a scheme determination unit determining a drive scheme from among candidates of a plurality of drive schemes having differing schemes for supplying a signal to a signal line of a display unit; and a scheme information transmitting step of a scheme information transmitting unit transmitting a scheme information indicating a drive scheme determined by the scheme determination step.

(18) In addition, one aspect of the present invention is a method of display control including: a scheme information acquisition step of a scheme information acquisition unit receiving a scheme information indicating a drive scheme; and a signal control step of a signal control unit controlling a signal supplied to a signal line of the display unit, based on a scheme information received by the scheme information acquisition unit and a scheme drive information in which a plurality of drive schemes having differing schemes of supplying a signal to a signal line of a display unit and a signal control information in the drive scheme in each of the plurality of drive schemes are associated.

Effect of the Invention

The present invention enables drive of a display device by an appropriate drive scheme.

BRIEF DESCRIPTION OF THE DRAWINGS

FIG. 6 is a simplified drawing showing an example of mode candidate information according to the present embodiment.

FIG. 10 is a simplified drawing showing an example of mode drive information according to the present embodiment.

FIG. 15 is a simplified drawing showing an example of the judgment criterion information according to the present embodiment.

FIG. 17 is a simplified drawing showing a variation example of judgment criterion information according to the present embodiment.

FIG. 20 is a simplified drawing showing an example of second mode candidate information according to the present embodiment.

FIG. 22 is a simplified drawing showing an example of second mode drive information according to the present embodiment.

FIG. 29 is a simplified drawing showing an example of display region capacity information according to a variation example of the various embodiments.

EMBODIMENT FOR CARRYING OUT THE INVENTION

Embodiments of the present invention will be described in detail below, with references made to the drawings.

Figure 1:
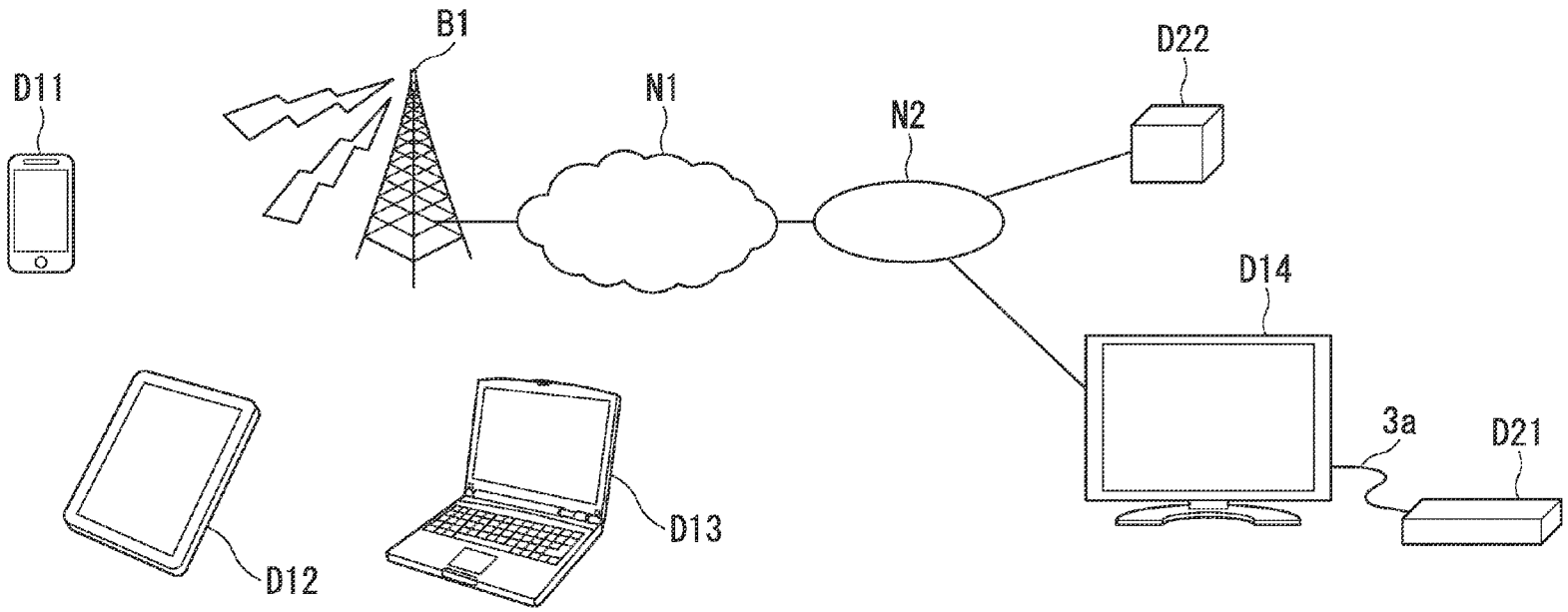
FIG. 1 is a simplified drawing showing an example of a display device according to various embodiments of the present invention.

FIG. 1 is a simplified drawing showing an example of a display device D1 according to various embodiments of the present invention. In this drawing, a mobile telephone handset D11, a tablet terminal D12, and a personal computer D13 are examples of a mobile display device D1. In contrast, a television device D14 is an example of a display device D1 installed in a home or shop. The present invention, however, is not restricted to these, and the display device D1 may be a digital camera, or a music player or the like. The display device D1 may be connected to a network or to another device. For example, the television device D14 may be directly connected to an external device D12 such as a computer or a recording/playback device, or may be connected to a server D22 via a network N2. In the same manner, the mobile telephone handset D11 or tablet terminal D12 or the like may also be connected to the server D22, via the networks N1 and N2.

Figure 2:
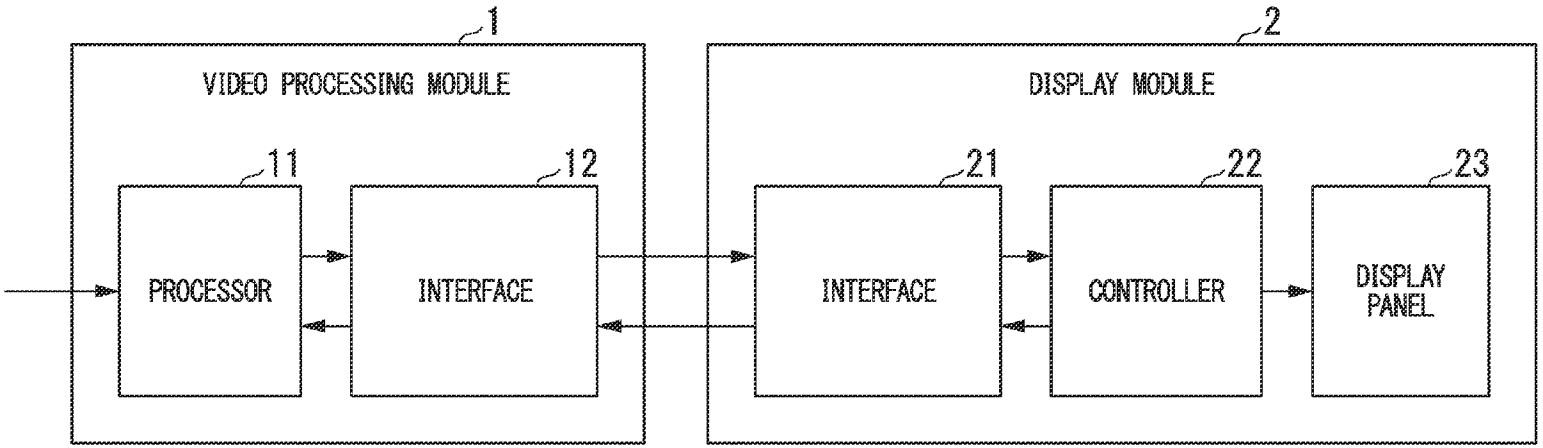
FIG. 2 is a simplified block diagram showing the constitution of a display control system according to various embodiments.

FIG. 2 is a simplified block diagram showing the constitution of a display control system according to the various embodiments. The display control system in this drawing has a video processing module 1 and a display module 2. The video processing module 1 is constituted to include a processor 11 and an interface 12. The display module 2 is constituted to include an interface 21, a controller 22, and a display panel 23 (display unit). The display control system may be included in one display devices D1 or in a plurality of devices. For example, the television device D14 in FIG. 1 may have a display module 2 and the external device D21 or the server D22 in FIG. 1 may have a video processing module 1.

The processor 11 determines a drive mode from a plurality of drive mode candidates having mutually different schemes for supplying signals to the signal lines of the display panel 23. In this case, the supplying scheme is, for example, the timing of supplying or stopping supply of signals to each pixel electrode, and the magnitude and polarity of the voltage of the signals to each pixel electrode. The processor 11 transmits mode information indicting the determined drive mode via the interface 12. The interface 12 and the interface 21 are connected by a cable, a circuit line, or the like.

The controller 22 stores the mode drive information, in which drive mode information and drive information are associated. The controller 22 receives mode information from the processor 11, via the interface 21. The controller 22, based on the received mode information and mode drive information, controls the signals supplied to signal lines of the display panel 23.

The above enables switching of the drive mode of the display module 2 from the processor 11 in a display control system. That is, the display control system can perform drive in a drive mode determined by the processor 11 from among a plurality of drive mode candidates of the display module 2. This enables the display control system to control drive flexibly and drive the display panel 23 in an appropriate drive mode.

First Embodiment

The first embodiment of the present invention will be described below in detail, with references made to the drawings. In the following, parts corresponding to parts in FIG. 2 are assigned similar reference symbols as in FIG. 2.

<Outer Appearance of the Display Control System>

Figure 3:
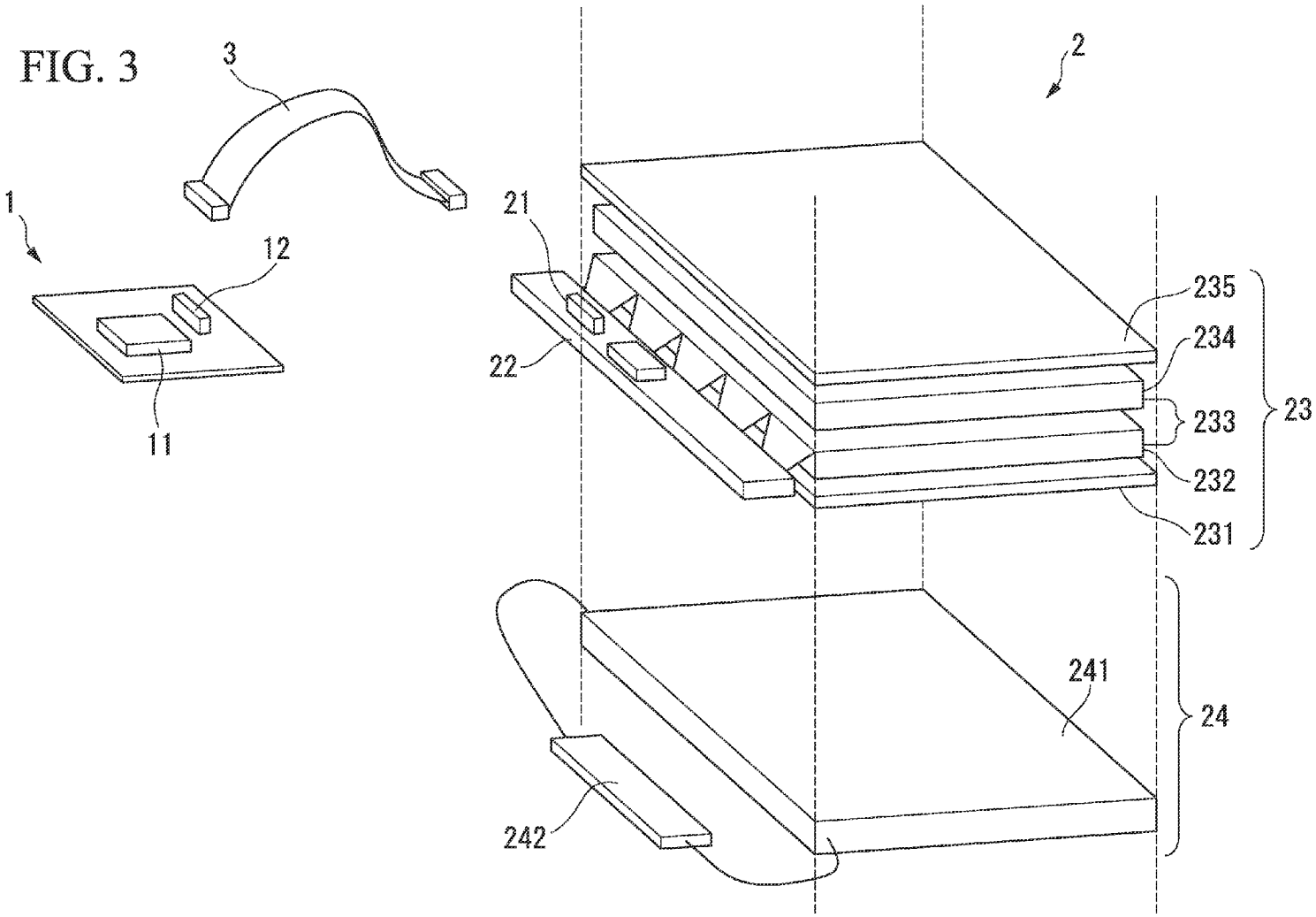
FIG. 3 is an oblique view showing the condition in which a part of the display device according to a first embodiment of the present invention is shown in exploded form.

FIG. 3 is an oblique view showing the condition in which a part of the display device D1 according to the first embodiment of the present invention is shown in exploded form. This drawing is an oblique view of a graphic chip 1, a liquid crystal module 2, and a cable 3.

The graphic chip 1 has a GPU (graphics processing unit) 11 and is provided thereon with a connector 12.

The controller 22 has a timing controller and the like, and is provided thereon with a connector 21. The connector 12 and the connector 21 are connected by the cable 3. The controller 22 controls the liquid crystal display device (LCD). Specifically, the controller 22 generates various signals, based on image data and mode commands sent from the graphic chip 1, via the cable 3. The controller 22 is connected to the liquid crystal panel 23 and supplies various generated signals to the liquid crystal panel 23.

The connector 12, the connector 21, and the cable 3 conform, for example, to the VESA (Video Electronics Standards Association) eDP (Embedded DisplayPort) standard. However, the connector 12, the connector 21, and the cable 3 may conform to the DP (DisplayPort) standard. As an example conforming to the DP standard, for example, there are cases in which the external device D21 of FIG. 1 has a graphic chip 1 and a connector 12, and the television device D14 has a controller 22 and a connector 21, and the cable 3 (cable 3*a* in FIG. 1) conforms to the DP standard. The connector 12, the connector 21, and the cable 3 may conform to a different standard, or alternately need not conform to a standard.

The liquid crystal panel 23 is constituted to include polarizing sheets 231 and 235, an array substrate 232 (TFT substrate), a liquid crystal layer 233, and a color filter substrate 234. The array substrate 232 is a glass substrate having on one side surface thereof a large number of TFTs (thin film transistors) arranged in a matrix. The electronic terminal group of the array substrate 232 is connected to the controller 22. The color filter substrate 234 is a glass substrate on which a color filter is placed. The color filter substrate 234 is provided, on one side surface thereof, with a common electrode. The liquid crystal layer 233 is sandwiched between the array substrate 232 and the color filter substrate 234. The polarizing sheets 231 and 235 are sheets or films that control the direction of oscillations of light waves.

A backlight 24 is constituted to include a light-emitting body 241 and an inverter 242. The light-emitting body 241 is constituted by, for example, a fluorescent lamp and a light-guiding sheet or diffusing sheet or the like.

The channel layer of the TFTs may be made from an oxide semiconductor having a wide forbidden band. If the forbidden band is wide, even if light from the backlight 24 strikes the channel layer, the number of excited carriers in the conduction band is reduced. This greatly reduces the leakage current occurring when a TFT is in the off state, compared with a channel layer of TFTs made of amorphous silicon. A typical oxide semiconductor having a wide forbidden band that can be used is InGaZnOx (IGZO), which has indium (In), gallium (Ga), zinc (Zn), and oxygen (O) as main components. In the present invention, however, the oxide semiconductor is not restricted to being IGZO. For example, one may be used that includes at least one of gallium, zinc, copper (Cu), silicon (Si), tin (Sn), aluminum (Al), calcium (Ca), germanium (Ge), and lead (Pb).

<Constitution of the Display Device D1>

Figure 4:
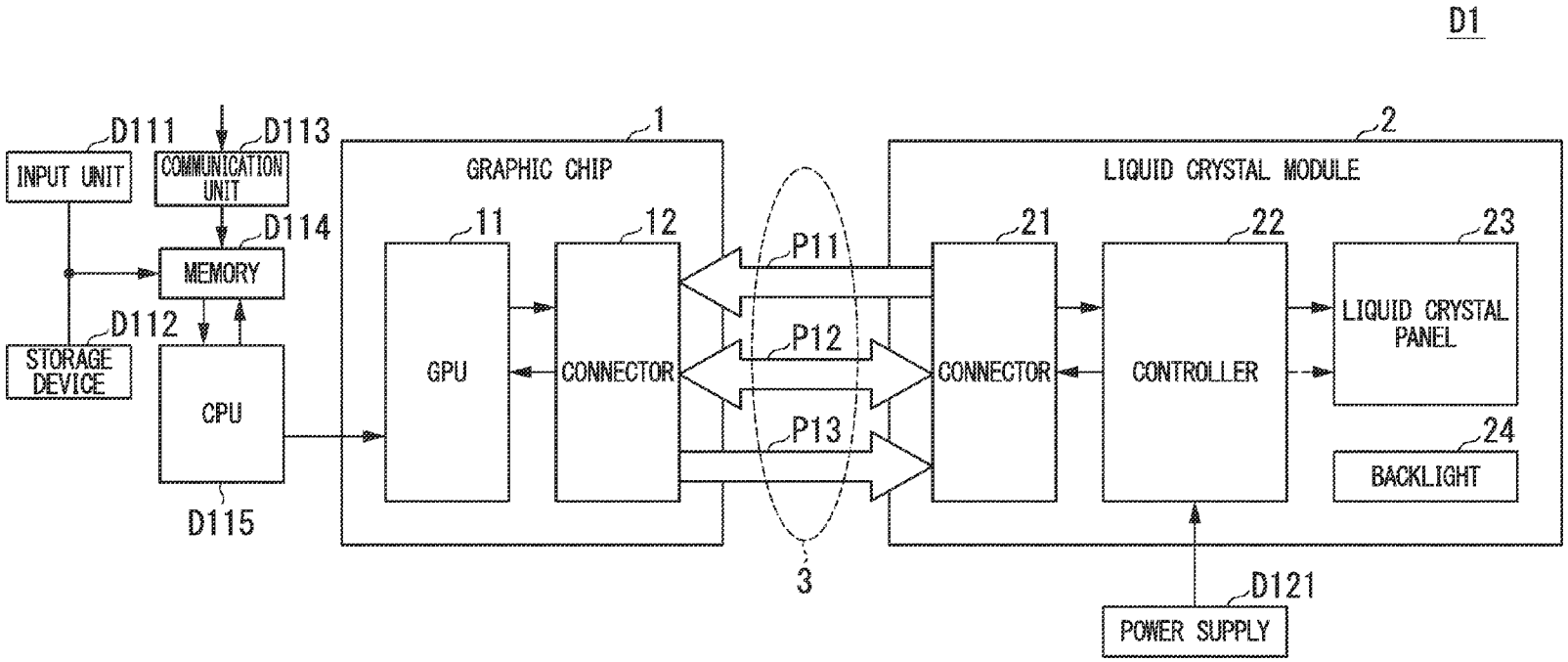
FIG. 4 is a simplified block diagram showing the constitution of the display device according to the present embodiment.

FIG. 4 is a simplified block diagram showing the constitution of the display device D1 according to the present embodiment. The display device D1 in this drawing is constituted to include an input unit D111, a storage device D112, a communication unit D113, a memory D114, a CPU (central processing unit) D115, a graphic chip 1, a liquid crystal module 2, a cable 3, and a power supply D121. The graphic chip 1 is constituted to include a GPU 11 and a connector 12. The liquid crystal module 2 is constituted to include a connector 21, a connector 22, a liquid crystal panel 23, and a backlight 24.

The input unit D111 is, for example, a touch panel, a mouse, or a keyboard. The input unit D111 senses an input from a user and outputs to the memory D114 input information indicating the input from the user.

The storage device D112 is, for example, a hard disk drive. The storage device D112 outputs to the memory D114 programs and data that it had stored beforehand.

The communication unit D113 receives information from the external device D21 or the server D22 or the like and outputs the received information to the memory D114.

The memory D114 stores information input from the input unit D111, the storage device D112, and the communication unit D113.

The CPU D115 reads in information from the memory D114 and, based on the read-in information, performs information processing. If the CPU D115 generates video as a result of information processing, video information indicating that video is output to the GPU 11.

Figure 5:
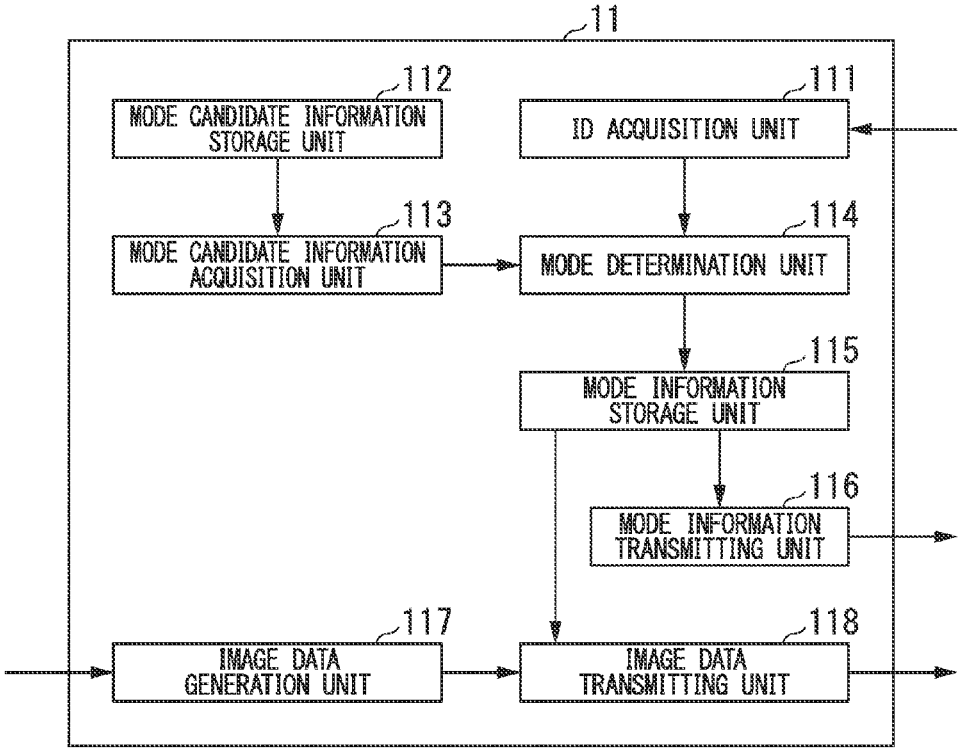
FIG. 5 is a simplified block diagram showing the logical constitution of a GPU according to the present embodiment.

The GPU 11 performs image processing with respect to the video represented by video information input from the CPU D115. The GPU 11 generates image data as a result of the image processing. The GPU 11 determines a drive mode from a plurality of drive mode candidates. In this case, each of the drive modes has a different scheme of supplying signals to the signal lines of the display panel 23. The GPU 11 generates a command (called a mode command) that includes the determined drive mode. The mode command may include information appended thereto indicating that the command is an extended command or command identification information that identifies the command. The GPU 11 outputs the generated image data and mode command to the connector 12. The details of the functions of the GPU 11 will be described later (FIG. 5).

The connector 12 transfers to the connector 21, via the cable 3, the image data and mode command input from the GPU 11. In this case, the transfer channel is, for example, constituted to include a hot-plug detect (HPD) P11, an auxiliary channel (AUX CH) P12, and a main link (Main Link) P13.

The hot plug detect P11 is a unidirectional transfer channel from the liquid crystal module 2 to the graphic chip 1. The hot plug detect P11 is a transfer channel for detecting the connection of hardware. For example, when the liquid crystal module 2 is connected, the GPU 11, via the hot plug detect P11, reads in the EDID (extended display identification data) of the liquid crystal module 2. The EDID includes the model number of the liquid crystal module 2 (identification information that identifies the product), information related to the display (panel resolution, input resolution, video format, and whether or not it is 3D video), and information related to audio. The EDID may include a company ID that identifies a company, in which case, for example, company may be the company that manufactures or the company that sells the liquid crystal module 2.

The auxiliary channel P12 is a bidirectional transfer channel between the liquid crystal module 2 and the graphic chip 1. The GPU 11 uses the auxiliary channel P12 to send a mode command. Because the mode command includes the drive mode and variables, there is a risk of inputting erroneous drive modes or variables. In the present embodiment, however, because the bidirectional auxiliary channel P12 is used, if an erroneous drive mode or variable is input, the liquid crystal module 2 can also transmit an error to the graphic chip 1. This enables the display control system to prevent, and recovery from, an erroneous input, enabling drive of the display device by an appropriate drive mode.

Also, the auxiliary channel P12 has a transfer rate such as 1 Mbps (megabits per second), which is slower than the transfer rate of the main link, to be described later. This enables the display control system to allocate the main link, which has a fast transfer rate, to the transfer of image data, which is a larger amount of data than the commands.

The main link P13 is a unidirectional transfer channel from the graphic chip 1 to the liquid crystal module 2. The main link P13 has a transfer rate of, for example, 1 to 21 Gbps (gigabits per second), which is faster than the transfer rate of the auxiliary channel P12. The GPU 11 uses the main link P13 to transmit image data.

The connector 21 receives image data and mode commands transferred from the connector 12 and outputs the received image data and mode commands to the controller 22.

Figure 9:
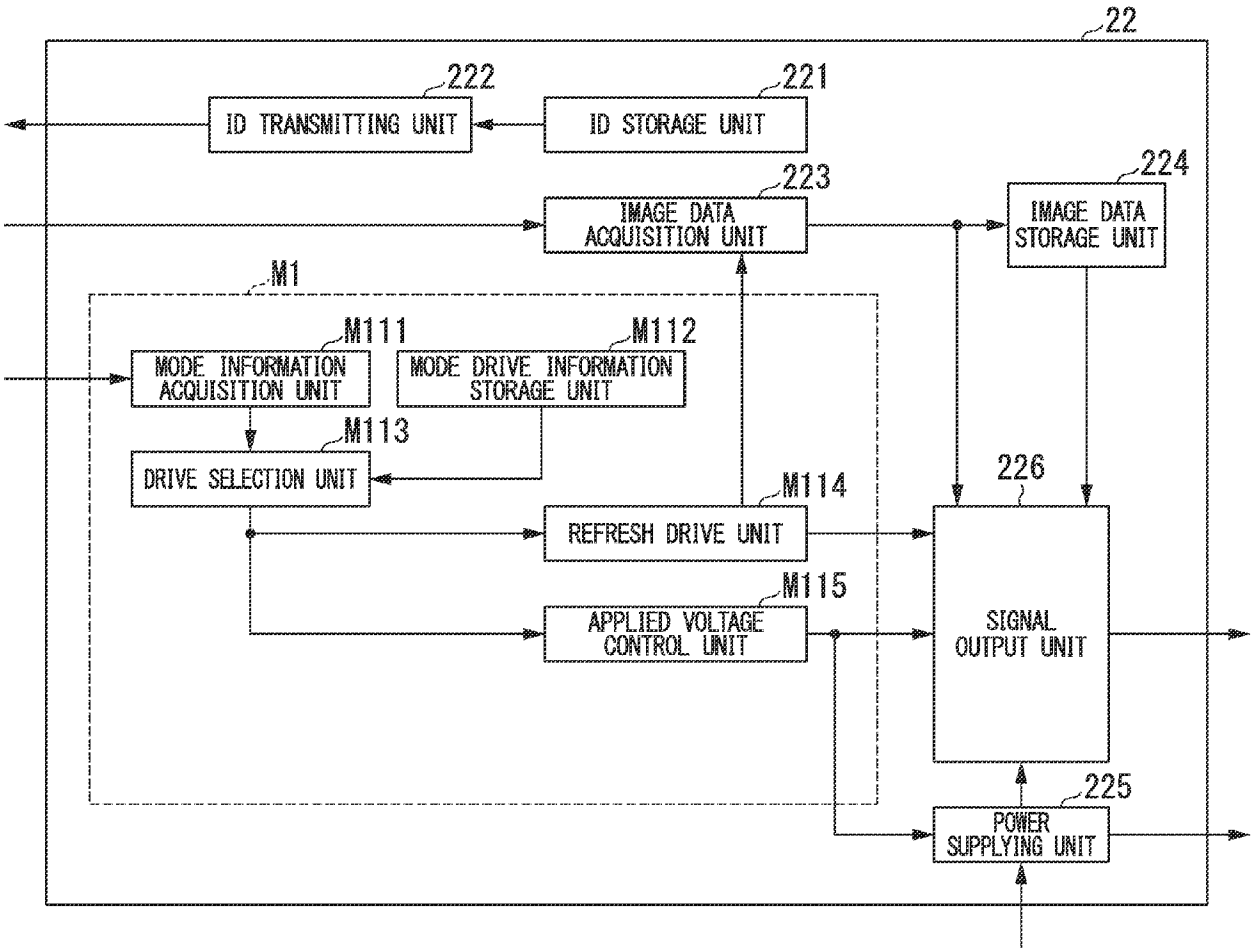
FIG. 9 is a simplified block diagram showing the logical constitution of a controller according to the present embodiment.

The controller 22 receives mode commands using the auxiliary channel P12 and receives image data using the main link P13. The controller 22 stores beforehand mode drive information, in which mode commands are associated with signal control information. The controller 22, based on the received mode commands and mode drive information, controls the signals supplied to the signal lines of the liquid crystal panel 23. Details of the functions of the controller 22 will be described later (FIG. 9).

The liquid crystal panel 23 is an optical element having two substrates that sandwich a liquid crystal layer therebetween and electrically controls the transmission or reflection of light (refer to FIG. 3). An electronic terminal group for the purpose of supplying drive signals is disposed in the peripheral part thereof.

The backlight 24 is a light source disposed on the rear surface of the liquid crystal panel and is constituted by a fluorescent lamp (hot cathode tube or cold cathode tube) and light-guiding sheet or diffusing sheet or the like.

The power supply D121 supplies electrical power to various parts of the display device D1. For example, the power supply D121 supplies power to the liquid crystal panel 23 via the controller 22.

<Logical Constitution of the GPU 11>

FIG. 5 is a simplified block diagram showing the logical constitution of the GPU 11 according to the present embodiment. The GPU 11 in this drawing is constituted to include an ID acquisition unit 111, a mode candidate information storage unit 112, a mode candidate information acquisition unit 113, a mode determination unit 114, a mode information storage unit 115, a mode information transmitting unit 116, an image data generation unit 117, and an image data transmitting unit 118.

The ID acquisition unit 111 receives an EDID transmitted using the hot plug detect P11. The ID acquisition unit 111 outputs the received EDID to the mode determination unit 114.

The mode candidate information storage unit 112 stores beforehand mode candidate information (FIG. 6) indicating drive mode candidates. The mode candidate information storage unit 112 may store mode candidate information acquired from outside via the communication unit D113, and may store mode candidate information written into it by the manufacturer at the time of manufacture.

FIG. 6 is a simplified drawing showing an example of the mode candidate information according to the present embodiment. In this drawing, the EDID, the refreshing type, the drive mode, and the variables are associated with each other in the mode candidate information. Although the EDID is a company ID indicating the company that manufactured the liquid crystal module 2, this can be other identification information included in the EDID (including identification information generated based on the EDID). The refreshing type is information indicating the panel self-refresh on/off state. Refreshing is the rewriting of the screen. Panel self-refresh is the continuous reading of video data stored in the liquid crystal module 2 side and the continuous writing of that video data onto the screen. This enables the continuous display of a still image on the screen even if, for example, video data is not transmitted from the graphic chip 1. If the refreshing type is EXIT, the panel self-refresh is off (first acquisition scheme). In contrast, if the refreshing type is ENTER, the panel self-refresh is on (second acquisition scheme). The variables indicate the type of variables appended to the commands.

As a convenience, the drive modes shown in FIG. 6 have, in addition to the drive mode identification information, the name of the drive mode indicated in parentheses (this will be done in the following as well). The drive modes are, for example, the following drive modes. The drive modes 1 to 5 are drive modes selectable when the panel self-refresh is off. In contrast, the drive modes 6 and 7 are drive modes selectable when the panel self-refresh is on.

(11) Normal Drive (Drive Mode 1)

In normal drive, the liquid crystal module 2 performs normal drive. For example, in normal drive, the refresh rate is 60 Hz (1 Hertz=1/s). In this case, the refresh rate (also called the R frequency) represents the number of refreshes in 1 second. That is, the refresh rate is the frequency of refreshing the display.

(12) Auto-Stopped Drive (Drive Mode 2)

In auto-stopped drive the liquid crystal module 2 automatically reduces the R frequency. That is, in auto-stopped drive, compared with normal drive, the refresh time interval (also referred to as the refresh interval) is made long. Because the liquid crystal module 2 is in the stopped state during the reference period, the stopped state is longer than in normal drive. This type of drive is called stopped drive. In stopped drive, the power consumption can be reduced compared to normal drive. For example, the R frequency in auto-stopped drive is 5 Hz.

(13) Stopped Drive 1: Frequency Selection (Drive Mode 3)

In stopped drive 1, the liquid crystal module 2 is driven with a specified R frequency. FIG. 6 shows that, in the case of drive mode 3, the R frequency is specified as a variable in the range from 5 Hz to 60 Hz. That is, in the case of drive mode 3, the mode command includes as a variable an R frequency of 5 Hz or greater and 60 Hz or lower.

(14) Stopped Drive 2: Partial (Drive Mode 4)

Stopped drive 2 (also called partial drive) is a drive scheme if, for example, the display region of the display panel 23 is divided, and mutually different drive is possible in each of the divided display regions. For example, in stopped drive 2, in at least two display regions of a plurality of display regions, the refreshing frequency of the display is different. FIG. 6 shows that, in drive mode 4, the display region identification information and the R frequency of each display region are specified as variables.

Figure 7:
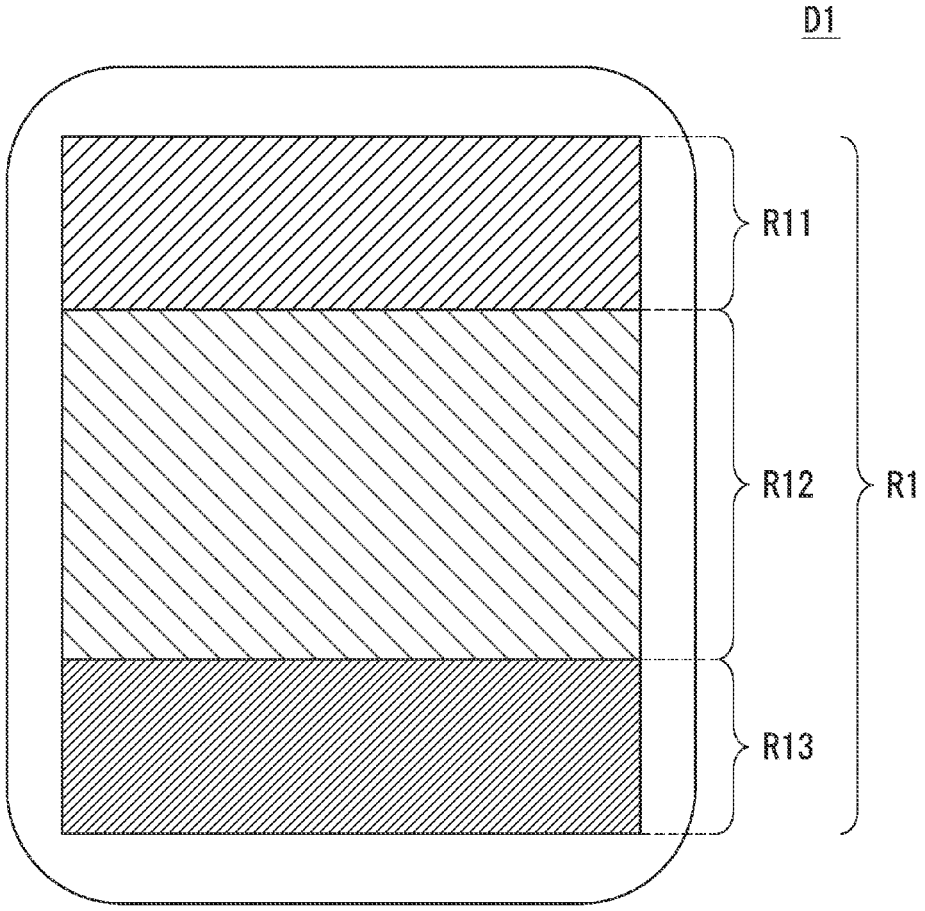
FIG. 7 is a simplified drawing showing an example of partial drive according to the present embodiment.

FIG. 7 is a simplified drawing showing an example of partial drive according to the present embodiment. The display device D1 in this drawing has a display region R1. The display region R1 is divided into the three display regions R11, R12, and R13 (which are taken to be the display regions 1, 2, and 3, where the 1, 2, and 3 are examples of display region identification information). For example, in the case of drive mode 4, if 5 Hz is specified for the display region 1, 30 Hz is specified for the display region 2, and 5 Hz is specified for the display region 3, the R frequency for the display region R12 is 30 Hz, and the R frequency for the display regions R11 and R13 is 5 Hz.

Returning below to FIG. 6, the description of the drive modes will continue.

(15) Overdrive Drive (Drive Mode 5)

In overdrive drive, a voltage higher than the normal voltage is applied to the drive circuit, and the speed of changing the pixels is increased. That is, in overdrive drive, the reference value (V2) of the voltage of the signals supplied to the signal lines of the display panel 23 is different from the reference value (V1) of the normal voltage. In this case, the voltage reference value may be, for example, the maximum value or amplitude of the voltage regarding a signal supplied to a signal line, or may be the average value thereof.

(16) Self-Stopped Drive 1: Frequency Selection (Drive Mode 6)

In self-stopped drive 1, the liquid crystal module 2 performs panel self-refresh at a specified R frequency. FIG. 6 shows that, in the case of drive mode 6, the R frequency is specified as a variable in the range from 5 Hz to 60 Hz. That is, in the case of drive mode 6, the mode command includes as a variable an R frequency of 5 Hz or greater and 60 Hz or lower.

In drive mode 6, the R frequency can be specified lower than 40 Hz, the specifiable value being lower than in drive mode 7, to be described below. This indicates that the liquid crystal module 2 with an EDID of AAA can perform panel self-refresh at an R frequency that is lower than that of the liquid crystal module 2 with an EDID of BBB.

(17) Self-Stopped Drive 2: Frequency Selection (Drive Mode 7)

In self-stopped drive 2, the liquid crystal module 2 performs panel self-refresh at a specified R frequency. FIG. 6 shows that, in the case of drive mode 7, the R frequency is specified as a variable in the range from 40 Hz to 60 Hz.

Returning to FIG. 5, the mode candidate information acquisition unit 113 reads out mode candidate information from the mode candidate information storage unit 112 and outputs the read-out mode candidate information to the mode determination unit 114.

The mode determination unit 114 determines the drive mode, based on the EDID input from the ID acquisition unit 111 and the mode candidate information input from the mode candidate information acquisition unit 113. Specifically, the mode determination unit 114 extracts the company ID from the EDID. The mode determination unit 114 determines the drive mode from among drive mode candidates corresponding to the extracted company ID in the mode candidate information. The mode determination unit 114 stores the determined drive mode into the mode information storage unit 115. The mode determination unit 114 may determine the drive mode for each individual screen (one frame), in which case the synchronization information or identification information for each frame may be stored in the mode information storage unit 115 in association with the drive mode.

The mode information transmitting unit 116 generates a mode command including the drive mode stored by the mode information storage unit 115. The mode information transmitting unit 116 transmits the generated mode command to the liquid crystal module 2 via the connector 12.

The image data generation unit 117 performs image processing with respect to video represented by video information input from the CPU D115. As a result of the video processing, the image data generation unit 117 generates image data for each single frame. The image data generation unit 117 outputs the generated image data to the image data transmitting unit 118.

The image data transmitting unit 118 transmits image data input from the image data generation unit 117 to the liquid crystal module 2, via the connector 12. In this case, the image data transmitting unit 118 may, for example, in accordance with the drive mode stored by the mode information storage unit 115, change the timing of transmitting the image data.

Specifically, if the refreshing type is EXIT, that is, in the case of drive mode in which the panel self-refresh is off (drive modes 1 to 5 in FIG. 6), the image data transmitting unit 118 determines the timing of transmitting the image data (called the image transmission timing) based on the R frequency. For example, if the drive mode is 2, the image data transmitting unit 118 sets the image transmission timing to timing (for example, 5 Hz (⅕ second)) based on the R frequency (5 Hz). However, the image data transmitting unit 118 may make the image transmission timing different from timing based on the R frequency.

<Circuit Constitution of the Liquid Crystal Module 2>

Figure 8:
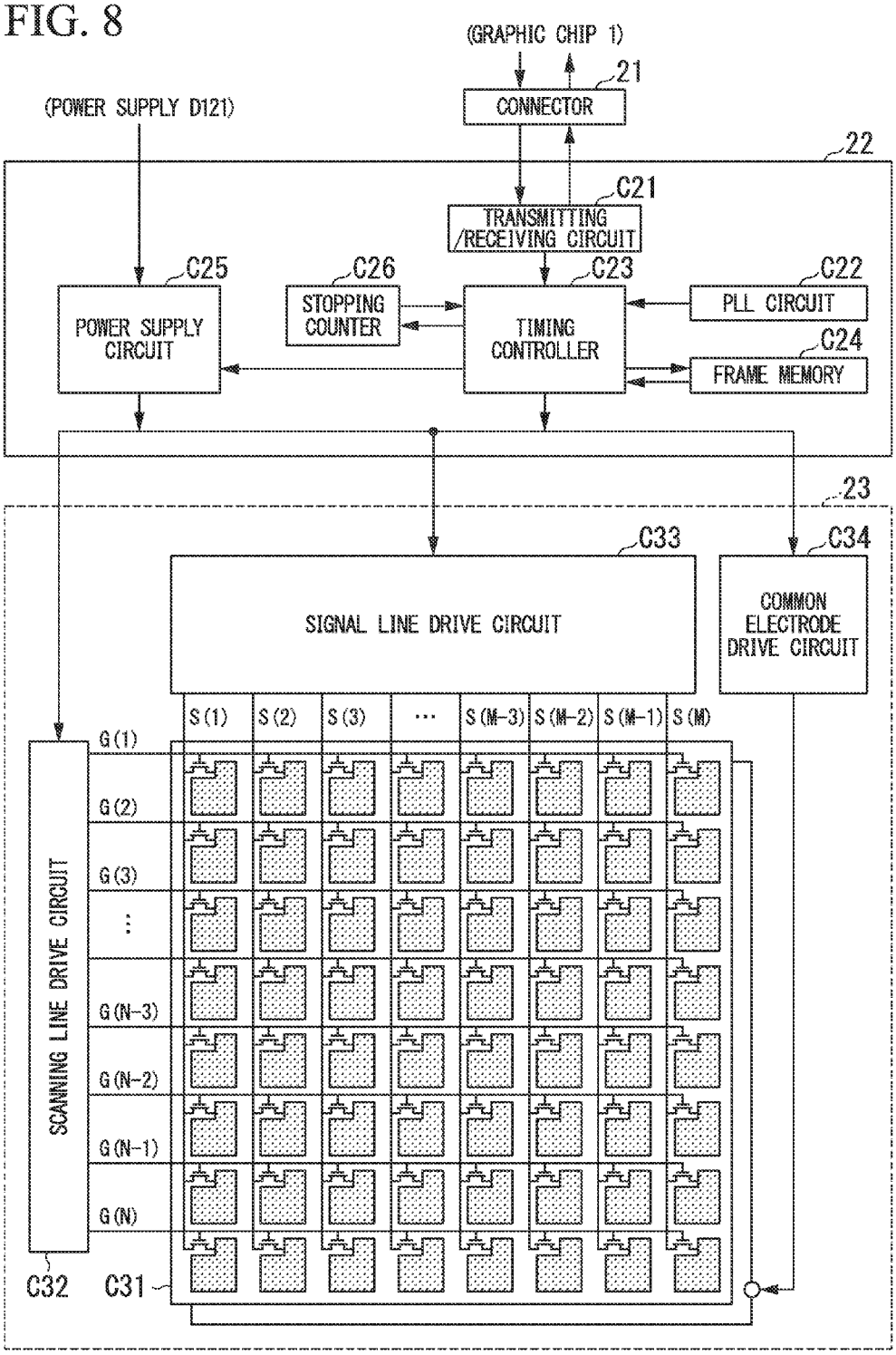
FIG. 8 is a simplified drawing showing the circuit constitution of a liquid crystal module 2.

FIG. 8 is a simplified drawing showing the circuit constitution of the liquid crystal module 2. The liquid crystal module 2 in this drawing is constituted to include a connector 21, a controller 22, and a liquid crystal panel 23.

The controller 22 has a transmitting/receiving circuit C21, a PLL (phased-locked loop) circuit C22, a timing controller C23, a frame memory C24, a power supply circuit C25, and a stopping counter C26.

The transmitting/receiving circuit C21, for example, receives image data and mode commands transmitted from the graphic chip 1, via the cable 3 and the connector 21. The PLL circuit C22 generates an internal clock signal. The timing controller C23 generates various clock and synchronization signals based on the internal clock signal generated in the PLL circuit C22. The frame memory C24 stores one frame of the image data received by the receiving circuit. The power supply circuit C25 supplies electrical power to a scanning line drive circuit C32, a signal line drive circuit C33, and a common electrode drive circuit C34. The stopping counter C26 stores the number of times the screen refresh is to be continuously stopped (refresh stopping count).

The liquid crystal panel 23 has a display circuit C31, the scanning line drive circuit C32, the signal line drive circuit C33, and the common electrode drive circuit C34.

The display circuit C31 has N×M pixel circuits disposed over an N×M matrix, N gate lines G(1) to G(N), and M source lines S(1) to S(M). Each of the pixel circuits has a pixel electrode. The gate lines G(1) to G(N) are arranged in the pixel row direction (along the direction of a pixel row). Each of the gate lines G(1) to G(N) is electrically connected to pixel electrodes of corresponding pixel row of a plurality of pixel rows. The source lines S(1) to S(M) are arranged in the pixel column direction (along the direction of a pixel column), and each thereof intersects with the gate lines G(1) to G(N). Each of the source lines S(1) to S(M) is electrically connected to pixel electrodes of a corresponding pixel column of a plurality of pixel columns.

The scanning line drive circuit C32 sequentially selects and scans the gate lines G(1) to G(N). Specifically, the scanning line drive circuit C32 scans the gate lines G(1) to G(N) by sequential selection thereof, supplying to the selected gate line G(n) (n=1, 2, . . . , N) an on voltage for switching a switching element (TFT) provided in each pixel circuit on the gate line G(n).

While the gate line G(n) is selected, the signal line drive circuit C33 supplies to each pixel circuit on the gate line G(n) a source signal responsive to the image data from the corresponding source line S(m) (m=1, 2, . . . , M). Specifically, the signal line drive circuit C33, based on the input video signal, calculates the voltage value to be output to each pixel circuit on the selected gate line G(n). The signal line drive circuit C33 outputs the calculated values of voltage to each source line S(m) from a source output amplifier. As a result, a source signal is supplied to each pixel circuit on the selected gate line G(n) (row n), and the source signal is written.

The common electrode drive circuit C34 supplies to the common electrode provided at each of the plurality of pixels a prescribed common voltage for driving the common electrodes.

<Logical Constitution of the Controller 22>

FIG. 9 is a simplified block diagram showing the logical constitution of the controller 22 according to the present embodiment. The controller 22 in this drawing is constituted to include an ID storage unit 221, an ID transmitting unit 222, an image data acquisition unit 223, an image data storage unit 224, a mode control unit M1, a power supplying unit 225, and a signal output unit 226. The mode control unit M1 is constituted to include a mode information acquisition unit M111, a mode drive information storage unit M112, a drive selection unit M113, a refresh drive unit M114, and an applied voltage control unit M115.

The ID storage unit 221 stores beforehand information regarding the liquid crystal module 2, which is included in the EDID.

The ID transmitting unit 222 transmits the EDID stored in the ID storage unit 221 to the graphic chip 1, via the connector 21. In this case, the ID transmitting unit 222 uses the hot plug detect P11 to transmit the EDID.

The image data acquisition unit 223 receives image data from the graphic chip 1, via the cable 3 and the connector 21. The image data acquisition unit 223 outputs the received image data to the signal output unit 226. In this case, in accordance with control from the refresh drive unit M114, to be described later, if panel self-refresh is to be done, the image data acquisition unit 223, for example, stores one frame of the received image data in the image data storage unit 224. The image data storage unit 224 may be the frame memory C24 shown in FIG. 8.

The mode information acquisition unit M111 receives a mode command from the graphic chip 1, via the cable 3 and the connector 21. In this case, the mode information acquisition unit M111 uses the auxiliary channel P12 to receive the mode command. The mode information acquisition unit M111 outputs the received mode command to the drive selection unit M113.

The mode information acquisition unit M111 may perform control based on a mode command upon receiving a mode command. For example, if the mode information acquisition unit M111 does not receive a mode command, the liquid crystal module 2, rather than performing control based on a mode command, may perform pre-established control. If the value of a drive mode or a variable included in a mode command is abnormal (for example, if the variable is not in a drive mode stored by the mode drive information storage unit M112 or is not within the variable range), the mode information acquisition unit M111 may transmit an error to the graphic chip 1.

The mode drive information storage unit M112 stores mode drive information (FIG. 10) beforehand. The mode drive information may be in the form of a two-dimensional table, or may be written into a program in firmware.

FIG. 10 is a simplified drawing showing an example of mode drive information according to the present embodiment. In the mode drive information shown in this drawing, the drive mode, R frequency, and applied voltage are associated with each other. That is, in the drive mode information the drive mode is associated with the signal control information (R frequency and applied voltage).

In this case, the applied voltage represents the reference value of the voltage of a signal supplied to a signal line of the display panel 23 (a signal line to one or a combination of a gate line G(n), a source line S(m), or a command electrode). The applied voltage may indicate the reference value of a voltage applied to a common electrode and a pixel electrode (liquid crystal). The reference value of a voltage may be a reference value such as the average value or the like of the applied voltage or may be the maximum value thereof. The "input value" is a value of a variable included in a command, that is, a specified value.

For example, FIG. 10 shows that, in the case of drive mode 2, the liquid crystal module 2 performs the above-noted auto-stopped drive, in which case the liquid crystal module 2 is driven with an R frequency of 5 Hz and with an applied voltage of V1 (where V is the unit of volts).

For example, FIG. 10 also shows that, in the case of drive mode 3, the liquid crystal module 2 performs the above-noted stopped drive 1, in which case the liquid crystal module 2 is driven with the R frequency as the R frequency and the applied voltage as the V1 (where V is the unit of volts) that are included in the mode command.

For example, FIG. 10 also shows that, in the case of drive mode 5, the above-noted overdrive drive is performed, in which case the liquid crystal module 2 is driven with an R frequency of 5 Hz and an applied voltage of V2 (where V2 is a voltage greater than V1).

For example, FIG. 10 also shows that, in the case of drive mode 4, the liquid crystal module 2 performs the above-described stopped drive 2 (partial drive), in which case the liquid crystal module 2, with the R frequency as the R frequency included in the mode command, applies a voltage responsive to that R frequency. Specifically, the liquid crystal module 2 is driven with an applied voltage V1 when the R frequency is 60 Hz, and with an applied voltage of Va when the R frequency is 40 Hz or greater and lower than 60 Hz. The liquid crystal module 2 is driven with an applied voltage of Vb when the R frequency is 5 Hz or greater and lower than 40 Hz.

The optimum level of applied voltage for suppressing flicker varies, depending upon the R frequency. In the present embodiment, the display control system, because the R frequency of each display region has applied thereto a voltage in accordance with the R frequency, can stop flicker over the entire screen. Also, for example, the relationship of voltages might be $V1 \leq Va < Vb$ or may be $Vb < Va \leq V1$. The GPU 11 may transmit a mode command that includes variables indicating the applied voltages for each individual display region, in which case the controller 22 may extract the variable from the mode command and apply the applied voltage indicated by the extracted variable to a signal supplied to the signal line corresponding to that display region. This enables the stopping of flicker over the entire screen at the GPU 11 side.

Returning to FIG. 9, the drive selection unit M113 extracts the drive mode and the variable from the mode command input from the mode information acquisition unit M111. The drive selection unit M113 reads out the extracted drive mode and the refreshing type, the R frequency, and the applied voltage corresponding thereto from the mode drive information stored in the mode drive information storage unit M112. The drive selection unit M113 outputs the read-out drive mode, refreshing type, and R frequency to the refresh drive unit M114 and outputs the read-out drive mode and applied voltage to the applied voltage control unit M115.

In this case, if the read-out R frequency is the "input value," the drive selection unit M113 outputs the variable extracted from the mode command as the R frequency.

The refresh drive unit M114 controls the signal output unit 226 in accordance with the drive mode, refreshing type, and R frequency input from the drive selection unit M113. Specifically, the refresh drive unit M114 controls the signal output unit 226 so as to refresh the screen, in accordance with the input R frequency. In this case, the refresh drive unit M114 refreshes the image, using the image data output by the image data acquisition unit 223 to the signal output unit 226.

If the refreshing type is ENTER (panel self-refresh), the image data received at the image data acquisition unit 223, for example, one frame thereof, is stored in the image data storage unit 224, in which case the refresh drive unit M114 uses the image data stored in the image data storage unit 224 to refresh the screen. In this case, until a pre-established period of time (the self-refresh period) has elapsed, or until the image data acquisition unit 223 acquires new image data, the refresh drive unit M114 uses the image data stored in the image data storage unit 224 to refresh the screen.

The refresh drive unit M114 may use the PLL circuit C22 and the stopping counter C26 of FIG. 8 to control the refresh period or the self-refresh period.

The applied voltage control unit M115, in accordance with the drive mode and applied voltage input from the drive selection unit M113, controls the signal output unit 226 and the power supplying unit 225. Specifically, the applied voltage control unit M115 controls the signal output unit 226 so that the input applied voltage is applied to the display panel 23.

The power supplying unit 225 converts the electrical power supplied from the power supply D121 and supplies the converted electrical power to circuits of the signal output unit 226 and the display panel 23. The power supplying unit 225 may be the power supply circuit 25 of FIG. 8.

The signal output unit 226, in accordance with control from the refresh drive unit M114 and the applied voltage control unit M115, controls the signals supplied to the signal lines of the display panel 23.

Specifically, the signal output unit 226 causes the scanning line drive circuit C32 to supply an on voltage to the gate lines G(1) to G(N) at the timing of the refreshing of the screen. At that timing, the signal output unit 226 outputs to the signal line drive circuit C33 a video signal corresponding to the image data.

In this case, if the image data acquisition unit 223 has received image data, the signal drive unit 226 temporarily stores the image data into a low-capacity memory (bypass RAM), and successively outputs a video signal of the stored image data to the signal line drive circuit C33. In contrast, in the case of panel self-refresh, the signal output unit 226 reads the image data stored in the image data storage unit 224 and outputs a video signal of the read-in image data to the signal line drive circuit C33.

The signal output unit 226 supplies to the scanning line drive circuit C32 an on voltage to be supplied to the gate lines G(1) to G(N) and supplies to the common electrode drive circuit C34 an applied voltage to be supplied to the common electrodes. The signal output unit 226 may, in accordance with control by the applied voltage control unit M115, control the applied voltage of the source signal output by the signal line drive circuit C33.

<Examples of Drive Switching>

Figure 11:
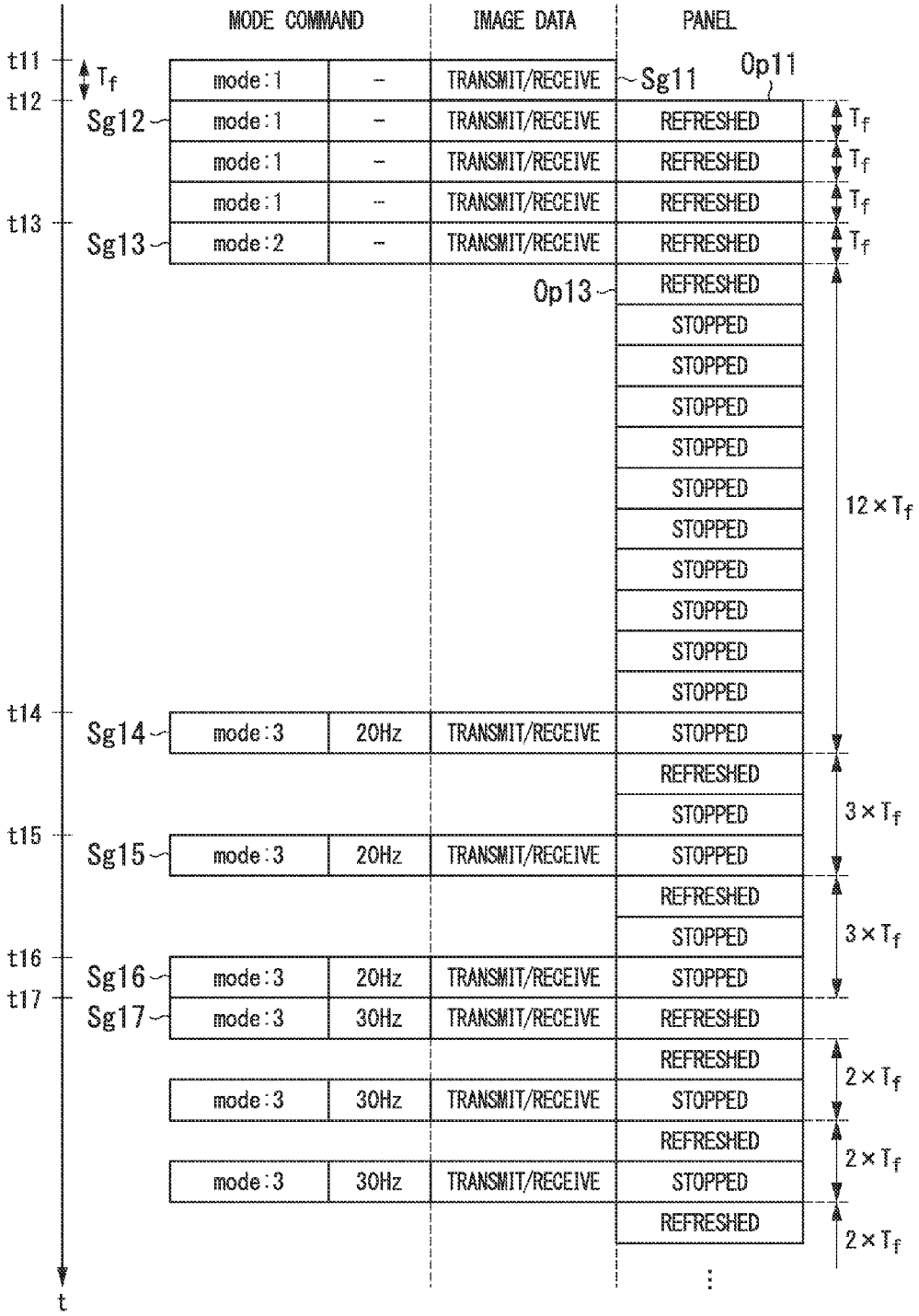
FIG. 11 is a simplified drawing showing an example of drive switching according to the present embodiment.
Figure 12:
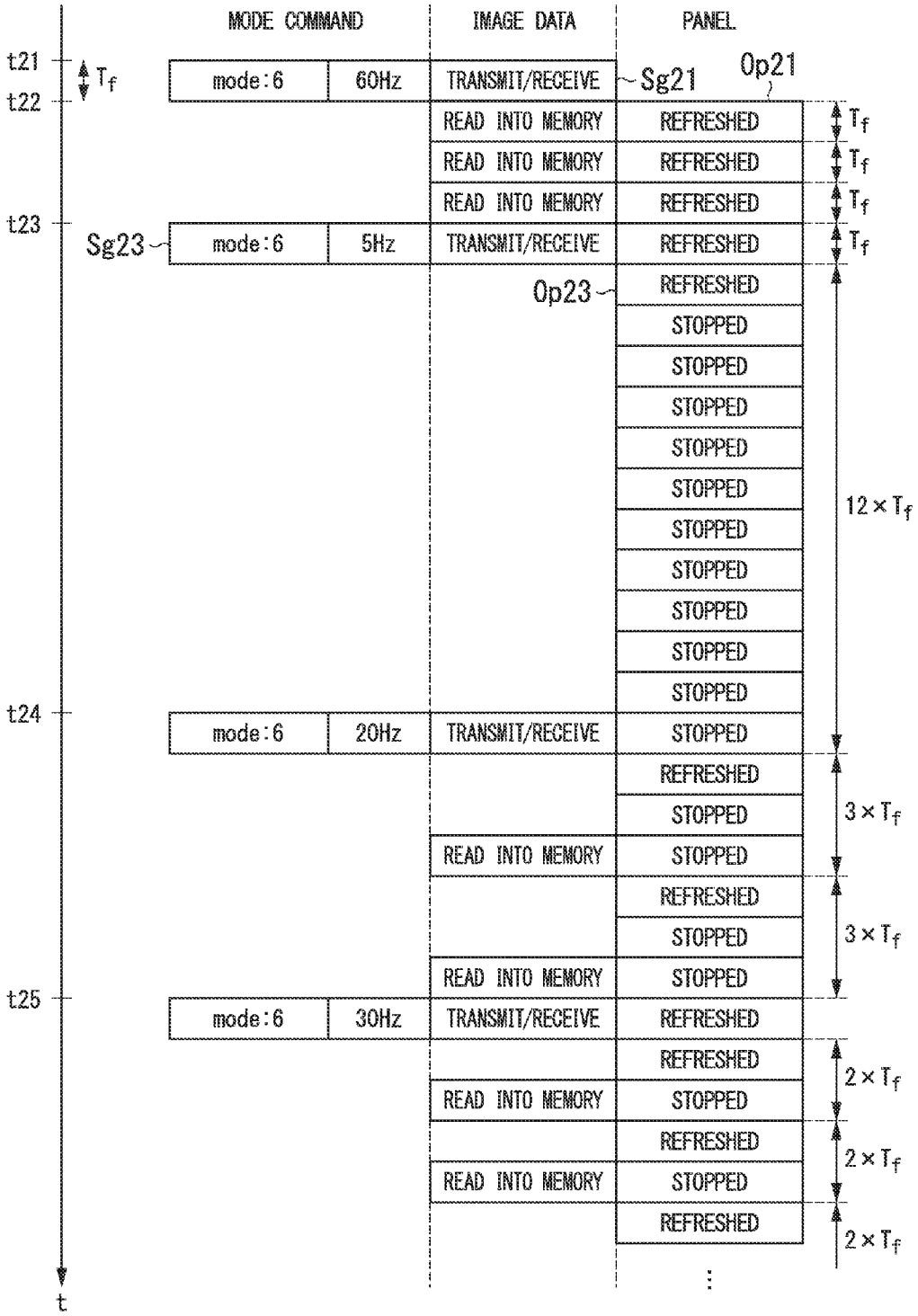
FIG. 12 is a simplified drawing showing another example of drive switching according to the present embodiment.

FIG. 11 and FIG. 12 are simplified drawings showing examples of drive switching according to the present embodiment. In FIG. 11 and FIG. 12, the vertical axis t is the time axis, and time $T_f$ represents the normal time interval of one frame (interval of one frame), this being, for example, 1/60 second.

The mode command "mode:X" represents the drive mode X and the Y of "YHz" represents the value of the R frequency. The image data "Transmit/receive" indicates that image data has been transferred from the graphic chip 1 to the liquid crystal module 2. The "Memory read-in" of image data in FIG. 12 indicates that, rather than the image data being transferred from the graphic chip 1 to the liquid crystal module 2, the liquid crystal module 2 reads out the image data that it had stored in itself. The "Refreshed" indicates that the liquid crystal module 2 refreshes the screen. The "Stopped" indicates that the liquid crystal module 2 does not refresh the screen, that is, that the screen refresh is stopped (Refresh stopped: stopped state).

FIG. 11 shows the case in which the refreshing type switches the EXIT drive mode.

At time t11, the liquid crystal module 2 receives the data Sg11 transmitted from the graphic chip 1. The data Sg11 includes image data and a mode command including the drive mode 1. The liquid crystal module 2, based on the data Sg11, drives in the drive mode 1 (normal drive) and refreshes the screen at 60 Hz (every $T_f$).

Time t12 is the time one frame interval of $T_f$ after time t11. At time t12, the liquid crystal module 2 receives data Sg11 transmitted from the graphic chip 1. The liquid crystal module 2 refreshes the screen (Op11) with the image data received at time t11. That is, after receiving the image data, the liquid crystal module 2 refreshes the screen using the image data at the next frame. After that, the liquid crystal module 2 receives a mode command and image data that have been transmitted from the graphic chip 1 at a timing based on the R frequency (every $T_f$).

At time t13, the liquid crystal module 2 receives the data Sg13 transmitted from the graphic chip 1. The data Sg13 includes image data and a mode command including the drive mode 2. The liquid crystal module 2, based on the data Sg13, drives in the drive mode 2 (auto-stopped drive) and refreshes the screen at 5 Hz (every $12\times T_f$). Specifically, at the next frame after time t13, the liquid crystal module 2 uses the image data received at time t13 to refresh the screen (Op13). The number of refresh stoppings 11 is stored in the stopping counter 26. This makes the liquid crystal module 2 refresh the screen every 12×Tf second.

At time t14, the liquid crystal module 2 receives the data Sg14 transmitted from the graphic chip 1. The data Sg14 includes image data along with a mode command including the drive mode 3 and the R frequency of 20 Hz. The liquid crystal module 2, based on the data Sg14, drives in the drive mode 3 (stopped drive 1) and refreshes the screen at 20 Hz (every $3\times T_f$). Specifically, the liquid crystal module 2 calculates the number of refresh stoppings as (60 Hz/R frequency)−1. As a result, the number of refresh stoppings of 2 is stored in the stopping counter 26. After that, the liquid crystal module 2 receives data (Sg15 and Sg16) transmitted from the graphic chip 1 at a timing (every $3\times T_f$) based on the R frequency.

At time t17, the liquid crystal module 2 receives the data Sg17 transmitted from the graphic chip 1. The data Sg17 includes image data, along with a mode command including the drive mode 3 and the R frequency of 30 Hz. In this manner, the graphic chip 1 and the liquid crystal module 2, at a time (t17) other than a time based on the R frequency (in FIG. 11, every $3\times T_f$ from t14), may transmit and receive command data and image data. The liquid crystal module 2, based on the data Sg17, drives in the drive mode 3 (stopped drive 1) and refreshes the screen at 30 Hz (every $2\times T_f$).

FIG. 12 shows the case in which the refreshing type switches the ENTER (panel self-refresh) drive.

At time t21, the liquid crystal module 2 receives the data Sg21 transmitted from the graphic chip 1. The data Sg21 includes image data, along with a mode command including the drive mode 6 and the R frequency of 60 Hz. The liquid crystal module 2, based on the data Sg21, drives in the drive mode 6 (auto-stopped drive) and refreshes the screen at 60 Hz (every $T_f$). In this case, the liquid crystal module 2 performs panel self-refresh.

Specifically, first, the liquid crystal module 2 stores one frame of the image data received at time t21 in the image data storage unit 224 (for example, the frame memory C24). At time t22, the liquid crystal module 2 refreshes the screen with the image data received at time t21 (Op21). In the case of panel self-refresh, after the next frame after time t22, the liquid crystal module 2 reads out one frame of image data stored in the image data storage unit 224 and refreshes the screen using the read-out image data (for example, Op22). This enables the liquid crystal module 2 to continue the display of an image even if the graphic chip 1 does not transmit data or, stated differently, even if the liquid crystal module 2 does not receive data after time t22 and before time t23.

At time t23, the liquid crystal module 2 receives the data Sg23 transmitted from the graphic chip 1. The data Sg23 includes image data, along with a mode command including the drive mode 6 and the R frequency of 5 Hz. The liquid crystal module 2, based on the data Sg23, drives in the drive mode 6 (self-stopped drive 1) and refreshes the image in the next frame, using the image data (Op23), after which it performs panel self-refresh at 5 Hz (every $12\times T_f$).

<Operation of the Display Device D1>

Figure 13:
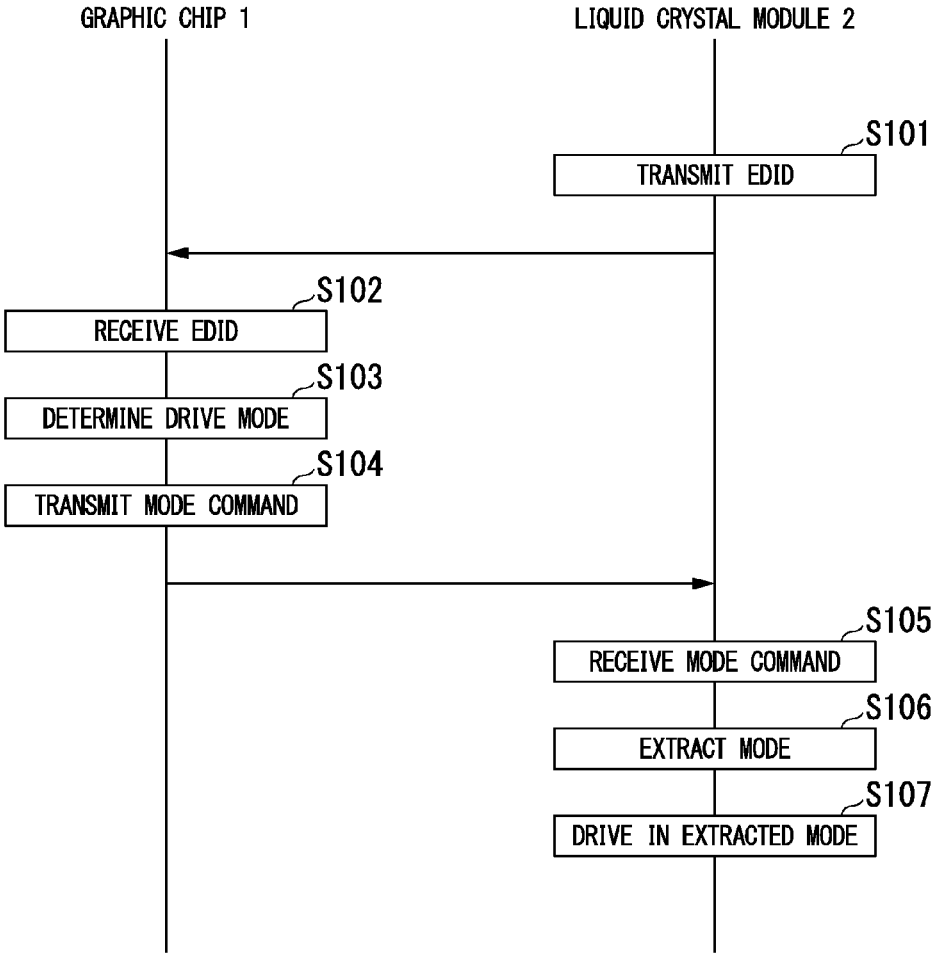
FIG. 13 is a sequence diagram showing the operation of a display device according to the present embodiment.

FIG. 13 is a sequence diagram showing the operation of the display device D1 according to the present embodiment.

(Step S101) The liquid crystal module 2 transmits the EDID to the graphic chip 1, after which processing proceeds to step S102.

(Step S102) The graphic chip 1 receives the EDID transmitted at step S101, after which processing proceeds to step S103.

(Step S103) The graphic chip 1, based on the EDID received at step S102, determines the drive mode, after which processing proceeds to step S104.

(Step S104) The graphic chip 1 generates a mode command that includes the drive mode determined at step S103 and transmits the generated mode command to the liquid crystal module 2, after which processing proceeds to step S105.

(Step S105) The liquid crystal module 2 receives the mode command transmitted at step S104, after which processing proceeds to step S106.

(Step S106) The liquid crystal module 2 extracts the drive mode from the mode command received at step S105, after which processing proceeds to step S107.

(Step S107) The liquid crystal module 2 drives in the drive mode extracted at step S106. After step S107, return may be made to step S101 or to step S103. In this case, based on the refresh interval or self-refresh interval, operation is stopped after step S107, after which return may be made to either step S101 or step S103.

In this manner, in the GPU 11 of the present embodiment, the mode determination unit 114 determines the drive mode from a plurality of drive mode candidates having mutually different schemes (for example R frequency or applied voltage) for supplying signals to signal lines of the display panel 23. The mode information transmitting unit 116 transmits mode information indicating the mode scheme determined by the mode determination unit 114. In the controller 22*b*, the mode drive information storage unit M112 stores mode drive information in which the drive mode information and signal control information in the drive mode are associated with one another. The mode information acquisition unit M111 receives mode information from the GPU 11. The signal output unit 226, based on the mode information and mode drive information received by the mode information acquisition unit M111, controls the signals to be supplied to the signal lines of the display panel 23. This enables the display device D1 to perform flexible drive control from the GPU 11 side and enables drive of the display panel 23 in an appropriate drive mode.

In the present embodiment, the frequency of refreshing the display in at least two signal drive modes differs. Specifically, the drive modes include normal drive and stopped drive, the R frequency differing between normal drive and stopped drive. This enables the display device D1 to perform flexible R frequency control from the GPU 11 side and enables drive of the display panel 23 in an appropriate drive mode.

In the present embodiment, at least one of the signal drive modes has mutually different display refresh frequencies in at least two display regions of the plurality of display regions R11, R12, and R13 (FIG. 7). Specifically, the drive modes include partial drive. This enables the display device D1 to perform, from the GPU 11 side, flexible control of whether partial drive is required and of the R frequencies in each display region, and enables drive of the display panel 23 in an appropriate drive mode.

In the present embodiment, the reference value (applied voltage) of the voltage of signals supplied to the signal line of the display panel 23 in at least two signal drive modes differs. Specifically, the drive modes include normal drive (or stopped drive) and overdrive drive, the applied voltages being mutually different between normal drive and overdrive drive. This enables the display device D1 to perform flexible control of the applied voltage from the GPU 11 side and enables drive of the display panel 23 in an appropriate drive mode.

In the present embodiment, the image data acquisition unit 233 acquires image data from the GPU 11. The image data storage unit 224 stores at least one frame of the image data acquired by the image data acquisition unit 223. In the second frame that follows after the first frame, the signal output unit 226 performs control with a first acquisition scheme that controls the signals supplied to the signal lines of the display panel 23 based on the image data of the second frame acquired by the image data acquisition unit 223, or control with the panel self-refresh that controls the signals supplied to the signal lines of the display panel 23 based on the image data of the first frame stored by the image data storage unit 224.

If the first acquisition scheme is selected, the mode determination unit 114 determines the drive mode from a plurality of drive mode candidates having mutually different display refresh frequencies. Specifically, if the refreshing type is EXIT, the drive modes include, for example, normal drive and stopped drive, the R frequencies being mutually different between normal drive and stopped drive. In the present embodiment, if the first acquisition scheme is selected the mode determination unit 114 determines the variable indicating the frequency of refreshing the display. Specifically, if the refreshing type is EXIT, the mode determination unit 114 determines the drive mode as 3 and 4 and specifies the R frequency as a variable.

This enables the display device D1 to perform, from the GPU 11 side, flexible control of whether partial drive is required and of the R frequencies in each display region, and enables drive of the display panel 23 in an appropriate drive mode.

Second Embodiment

The second embodiment of the present invention will be described in detail below, with references made to the drawings. In the present embodiment, the graphic chip 1 acquires information for determining the drive mode and determines the drive mode based on the acquired information. The display device D1 according to the present embodiment has the GPU 11*a* in place of the GPU 11 in the display device D1 according to the first embodiment. Although in the present embodiment GPU 11*a* is one example of the processor 11 in FIG. 1, the present invention is not restricted in this manner, and both the GPU 11*a* and the CPU D115 may be examples of the processor 11.

<Logical Constitution of the GPU 11*a*>

Figure 14:
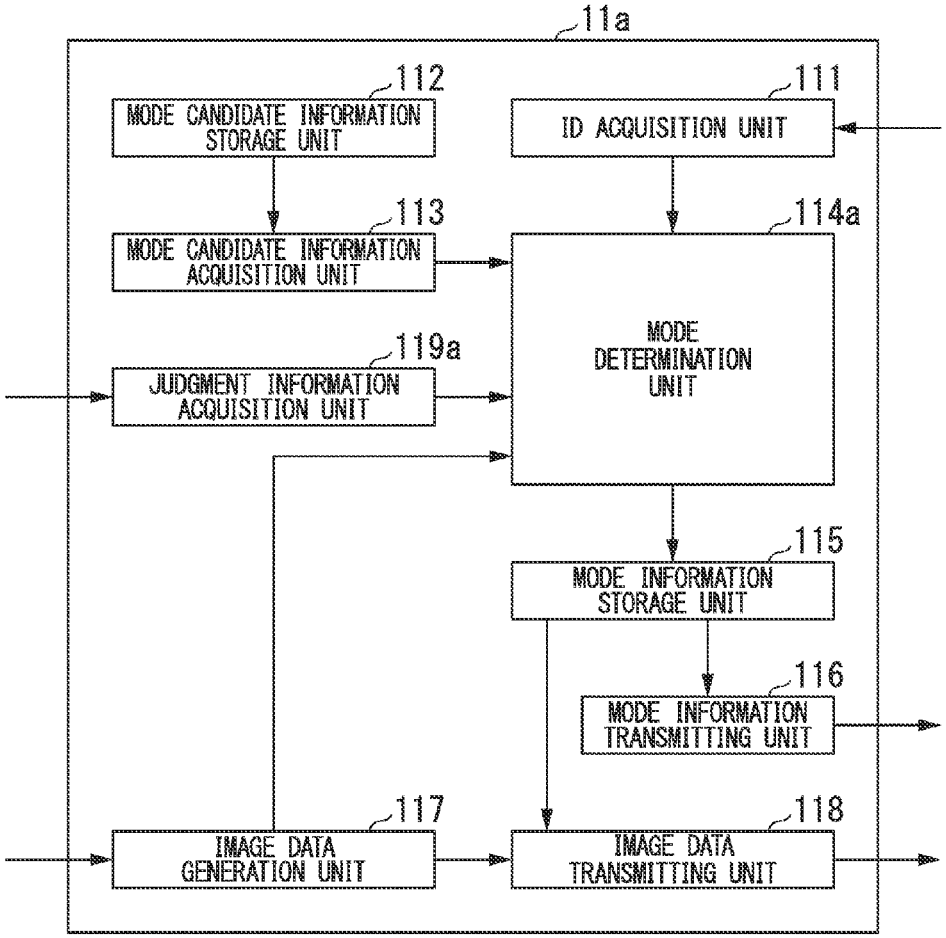
FIG. 14 is a simplified block diagram showing the logical constitution of a GPU according to a second embodiment of the present invention.

FIG. 14 is a simplified block diagram showing the logical constitution of the GPU 11*a* according to the second embodiment of the present invention. Comparing the GPU 11*a* (FIG. 14) according to the present embodiment with the GPU 11 (FIG. 5) according to the first embodiment, the judgment information acquisition unit 119*a* and the mode determination unit 114*a* are different. However, the functions of other constituent elements are the same as in the first embodiment, and the description of the functions that are the same as in the first embodiment will be omitted.

The judgment information acquisition unit 119*a* stores judgment criterion information (FIG. 15) beforehand. The judgment information acquisition unit 119*a* acquires judgment information for use in judging from the CPU D115. The judgment information acquisition unit 119*a* outputs the judgment criterion information and the judgment information to the mode determination unit 114*a*.

The mode determination unit 114*a*, in addition to the functions of the mode determination unit 114 of the first embodiment, has the following function. Specifically, the mode determination unit 114*a* selects drive mode candidates corresponding to the EDID from the mode candidate information. The mode determination unit 114*a*, based on the judgment criterion information and judgment information input from the judgment information acquisition unit 119*a*, and on image data generated by the image data generation unit 117, determines the drive mode from among the selected drive mode candidates. The mode determination unit 114*a* stores the determined drive mode in the mode information storage unit 115.

FIG. 15 is a simplified drawing showing an example of the judgment criterion information according to the present embodiment. In this drawing, in the judgment criterion information the contents, drive mode, change conditions, and drive mode after change are associated with each other. In this case, the contents is individual information such as text, audio, or video, which are to be provided by information services, for example, the contents to be displayed. The mode determination unit 114*a* judges the contents type based on the image data generated by the image data generation unit 117.

For example, FIG. 15 shows that, if the contents is video, the mode determination unit 114*a* determines the drive mode as 1 (normal drive).

FIG. 15 shows that, if the contents is still picture, text, web, or electronic book, the mode determination unit 114*a* determines the drive mode to be 2 (auto-stopped drive), 3 (stopped drive 1), or 6 (self-stopped drive 1). In this case, when the input unit D111 senses input from a user (satisfying the change condition "user input"), the mode determination unit 114*a* changes the drive mode to 1 (normal drive) from 2, 3, or 6.

That is, because in the case of a still picture, text, web, or electronic book, there is a high probability of the change (time change) of the image being small (for example, in the case of still pictures), the mode determination unit 114*a* makes the determination of the stopped drive. This enables the display device D1 to decrease the R frequency and to reduce the power consumption in the case of images with a small amount of change. After that, if there has been an input from a user, because there is a high probably that the image will change, the mode determination unit 114*a* changes the mode to normal drive. In this manner, the mode determination unit 114*a* may change the drive mode based on the input from the user. By doing this, if the image changes, the display device D1 can increase the R frequency compared with stopped drive, thereby improving the display quality of a changing image.

If the contents is still image, text, web, or electronic book and the drive mode is determined as 6, and when input from a user is sensed, the mode determination unit 114*a* may change the drive mode from 6 to 3 (stopped drive 1). That is, in the drive mode 6, because the liquid crystal module 2 performs panel self-refresh, the displayed image data is not updated. Because the mode determination unit 114*a*, based on input from a user, releases the panel self-refresh, even if the image is changed by the input, the liquid crystal module 2 can display the changed image data.

FIG. 15 also shows that, if the contents is partial video, the mode determination unit 114*a* determines the drive mode as 4 (auto-stopped drive 2). In this case, a partial video is, for example, the case in which there is a video display region within a web browser.

Figure 16:
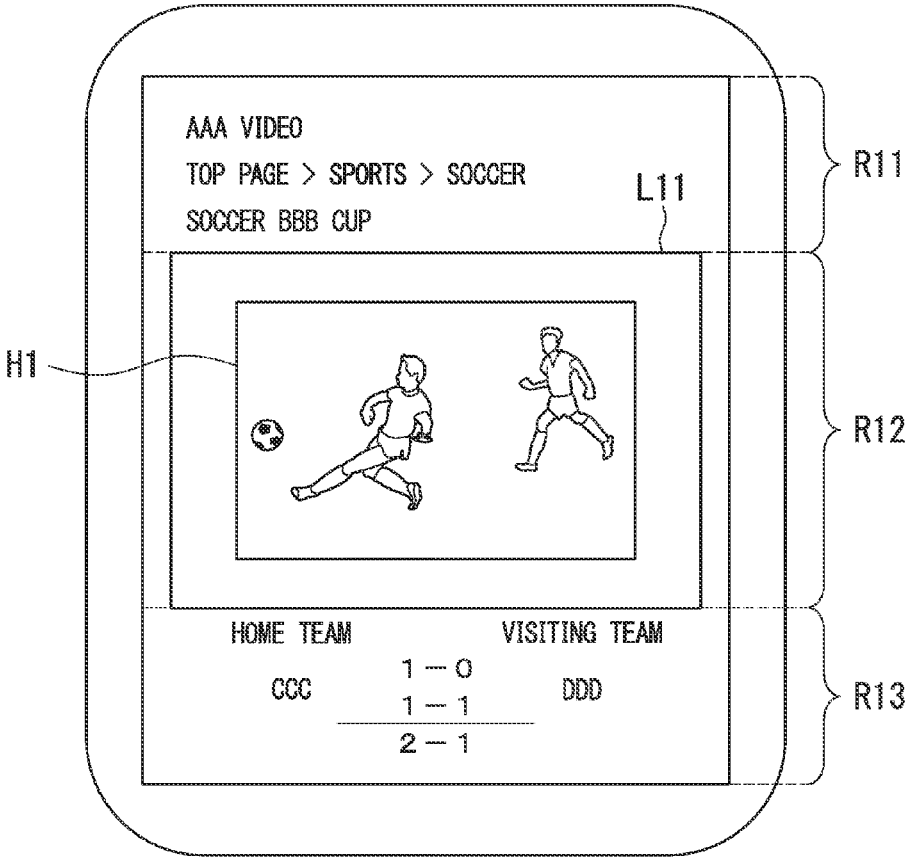
FIG. 16 is a simplified drawing showing an example of a display during partial drive according to the present embodiment.

FIG. 16 is a simplified drawing showing an example of the display in the partial drive mode according to the present embodiment. This drawing shows an example of the display when the mode determination unit 114*a* has determined the drive mode to be 4 (auto-stopped drive 2). This display is an example of the display by the display device D1 having the same display region as FIG. 7.

In FIG. 16, the web browser includes a video display region H1 that displays a video. The video display region H1 is located within the display region 2 (display region R12). In this case, the mode determination unit 114*a*, with the R frequency in the display region that includes the video being, for example, 60 Hz, sets the R frequency of the other display regions 1 and 3 (display regions R11 and R13) to 5 Hz.

In this manner, the mode determination unit 114*a* determines a drive mode having a low R frequency in a display region having a small amount of change of the image, and a drive mode having a high R frequency in a display region having a lot of change of the image. This enables the display device D1, for example, to decrease the R frequency in a display region having a small amount of image change, thereby enabling a reduction of the power consumption. In contrast, in a display region having a changing image, the display device D1 can increase the R frequency relative to stopped drive, thereby enabling an improvement in the display quality of a changing image.

In FIG. 16, the R frequency inside the region L11 surrounded by the line marked with the reference symbol L11 is higher than outside the region. In this manner, by displaying an image (line L11) indicating a region having an R frequency higher than other regions, the display device D1 clearly indicates to the user the region in which the R frequency is high. This, for example, enables a video to be moved to the region having a high R frequency, thereby improving the display quality of the video. The present invention is not restricted in this manner, and may display an image to indicate a region having an R frequency lower than other regions.

In this manner, in the GPU 11 of the present embodiment, the image data generation unit 117 generates image data. The mode determination unit 114*a* determines the drive mode, based on the image data generated by the image data generation unit 117. This enables the display device D1 to generate image data at the GPU 11 side and to determine the drive mode based on that image data. The display device D1 can therefore flexibly control the drive from the GPU 11 side and drive the display panel 23 in an appropriate drive mode.

Variation Example

FIG. 17 is a simplified drawing showing a variation example of the judgment criterion information according to the present embodiment. In this drawing, the application, the drive mode, the change conditions and the drive mode after the change are associated in the judgment criterion information. In this case, the application indicates the type of application software. In the present invention, however, this is not a restriction, and this may be the type of a function that the application software has. In this manner, the mode determination unit 114*a* may change the drive mode based on the type of software or on the function thereof. By doing this, for example, if software or a function is executed for which the image change is small, the display device D1 can decrease the R frequency and reduce the power consumption. In contrast, if software or a function is executed for which the image changes, the display device D1 can increase the R frequency compared with stopped drive, thereby improving the display quality of a changing image.

Third Embodiment

The third embodiment of the present invention will be described in detail below, with references made to the drawings. In the present embodiment, the display device D1 (display control system) performs alternating current drive, in which the polarity (POL, simply called polarity) of the voltage applied to the liquid crystal is changed (reversed) in the time direction.

Specifically, the graphic chip 1 of FIG. 4 determines a second drive mode from among drive mode (second drive mode) candidates having different alternating current drive. The graphic chip 1 transmits a mode command including the determined second drive mode to the liquid crystal module 2. The liquid crystal module 2 controls the supply of signals to the signal lines of the display panel 23, based on the second drive mode included in the mode command transmitted form the graphic chip 1.

In the display device D1 according to the present embodiment the GPU 11 of the display device D1 of the first and second embodiments is replaced by a GPU 11*b*, and the controller 22 thereof is replaced by a controller 22*b*.

Figure 18:
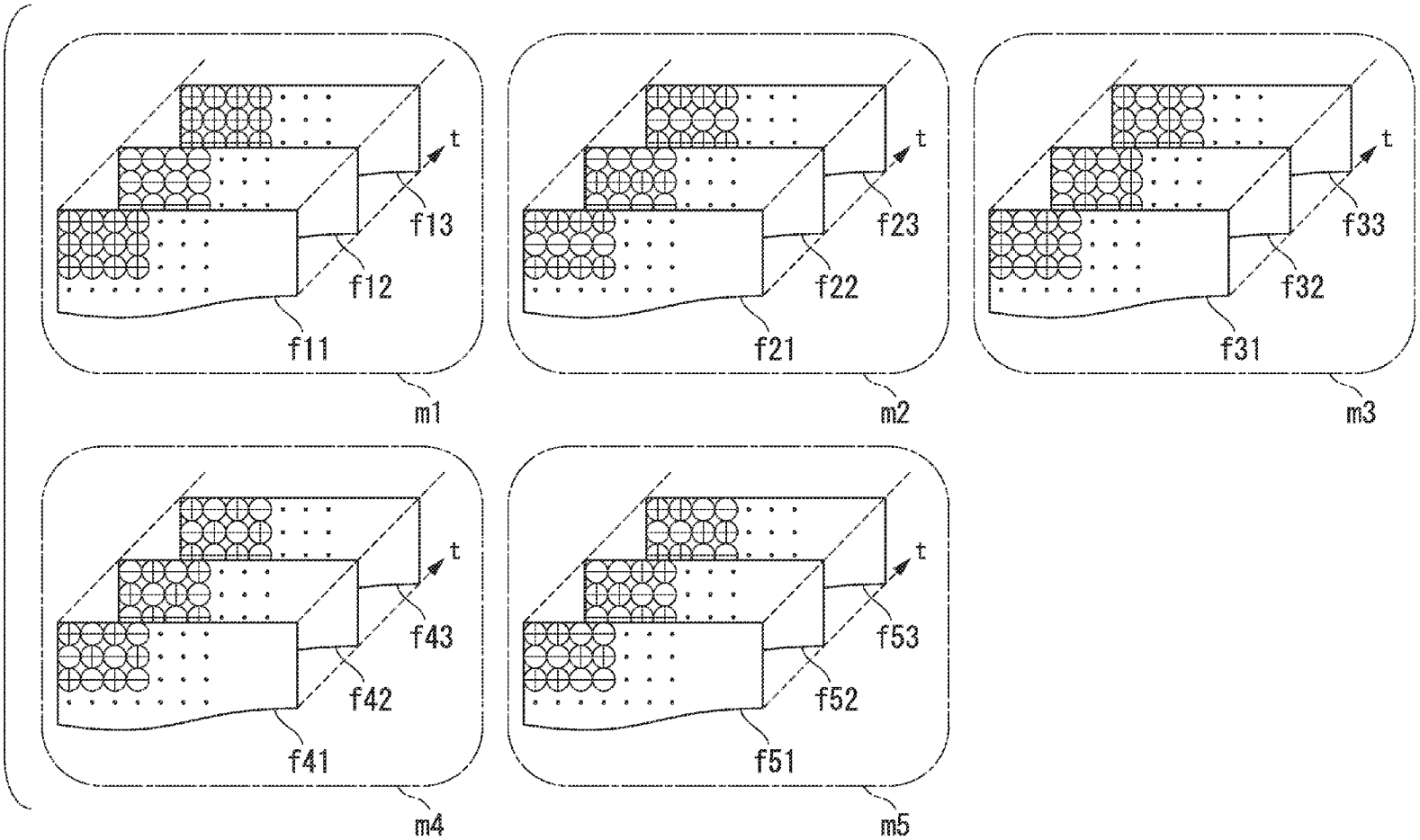
FIG. 18 is a drawing describing an example of a second drive mode according to a third embodiment of the present invention.

FIG. 18 is a drawing describing examples of the second drive mode according to the third embodiment of the present invention. FIG. 18 shows frame reversal drive m1, horizontal line reversal drive m2, vertical line reversal drive m3, dot reversal drive m4, and 2-dot reversal drive m5.

(21) Frame Reversal Drive

Frame reversal drive is an alternating current drive scheme in which all of the pixels within the same frame have voltages of the same polarity applied thereto. Frame reversal drive is an alternating current drive scheme in which the polarity is reversed in units of frames. For example, the polarity of all pixels within frame f11 is "+" (positive) and the polarity of all pixels within frame f12 is "−" (negative).

(22) Horizontal Line Reversal Drive

Horizontal line reversal drive is an alternating current drive scheme in which, within the same frame, the polarity of the voltage applied to each pixel in neighboring signal lines is reversed. For example, in the frame f21, the polarity of the pixels of the odd-numbered (1, 3, . . . ) rows is "+" and the polarity of the pixels of the even-numbered rows is "−". In the next frame f22, the polarity of the pixels of the even-numbered rows is "+" and the polarity of the pixels of the odd-numbered rows is "−". Horizontal line reversal drive is also called H line reversal drive and row reversal drive.

(23) Vertical Line Reversal Drive

Vertical line reversal drive is an alternating current drive scheme in which, within the same frame, the polarity of the voltage applied to each pixel is reversed for each neighboring scan line. For example, in the frame f31, the polarity of the pixels of the odd-numbered columns is "+" and the polarity of the pixels of the even-numbered columns is "−". In the next frame f32, the polarity of the even-numbered columns is "+" and the polarity of pixels of the odd-numbered columns is "−". Vertical line reversal drive is also called V line reversal drive or column reversal drive.

(24) Dot Reversal Drive

Dot reversal drive is an alternating current drive scheme in which, within the same frame, the polarity of the voltage applied to mutually neighboring pixels (dots) is reversed. For example, in the frame f41, the polarity of the voltage applied to the pixels of odd-numbered rows and odd-numbered columns and the pixels of even-numbered rows and even-numbered columns is "+", and the polarity of the pixels of odd-numbered rows and even-numbered columns and the pixels of even-numbered rows and odd-numbered columns is "−". In the frame f42, the polarity of the pixels of odd-numbered rows and even-numbered columns and the pixels of even-numbered rows and odd-numbered columns is "+", and the polarity of the pixels of odd-numbered rows and odd-numbered columns and the pixels of even-numbered rows and even-numbered columns is "−".

(25) K-Dot Reversal Drive

K-dot reversal drive (K is an integer of 2 or greater) is an alternating current drive scheme in which, in the same frame, the polarity of the voltage applied to each pixel is reversed in units of K mutually neighboring pixels.

<Logical Constitution of the GPU 11*b*>

Figure 19:
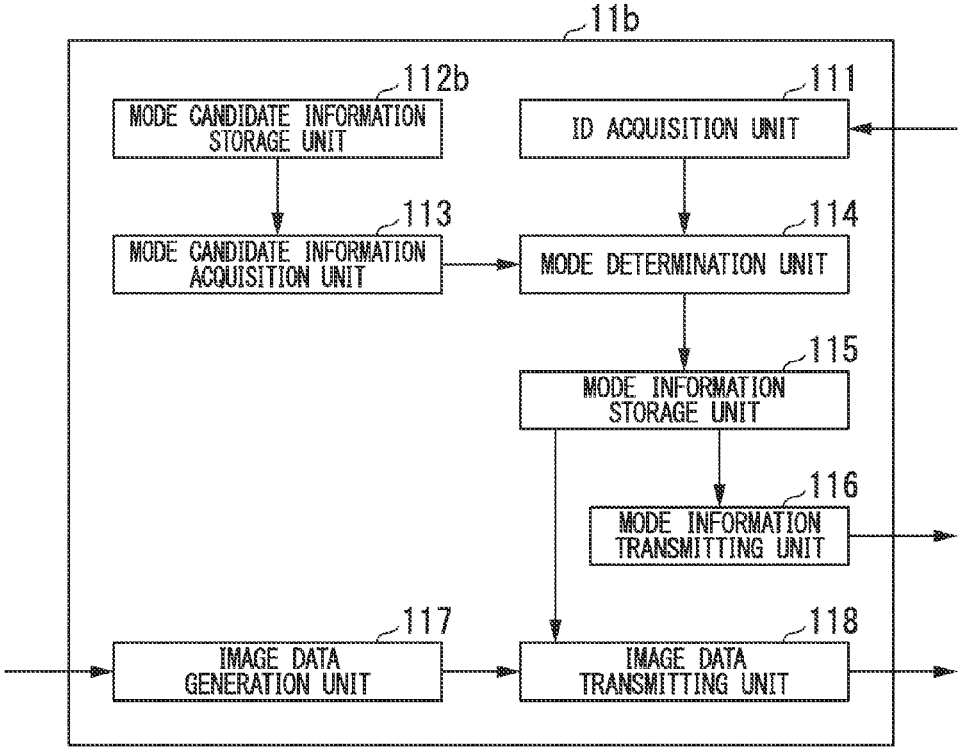
FIG. 19 is a simplified block diagram showing the logical constitution of a GPU according to the present embodiment.

FIG. 19 is a simplified block diagram showing the logical constitution of the GPU 11*b* according to the present embodiment. Comparing the GPU 11*b* according to the present embodiment (FIG. 19) with the GPU 11 according to the first embodiment (FIG. 5), the mode candidate information storage unit 112*b* is different. However, the functions of other constituent elements are the same as in the first embodiment, and the description of the functions that are the same as in the first embodiment will be omitted.

The mode candidate information storage unit 112*b*, in addition to the mode candidate information (FIG. 6), stores beforehand the second drive candidate mode information (FIG. 20) indicating second drive mode candidates. However, the present invention is not restricted to this, and the mode candidate information storage unit 112*b* need not store the mode candidate information (FIG. 6).

FIG. 20 is a simplified drawing showing an example of second mode candidate information according to the present embodiment. In this drawing, the EDID, the second drive mode, and the variables are associated with each other in the mode candidate information.

Of the second drive modes, in the reversal drive 1 (in which the last digit of the second drive mode is 0) and the reversal drive 2 (in which the last digit of the second drive mode is 1), the R frequencies are mutually different. Also, in the reversal drive 3 (in which the last digit of the second drive mode is 2), the R frequency is specified as a variable. In the second drive mode 152, the dot interval (the above-described variable K) for dot reversal drive is also specified.

<Logical Constitution of the Controller 22*b*>

Figure 21:
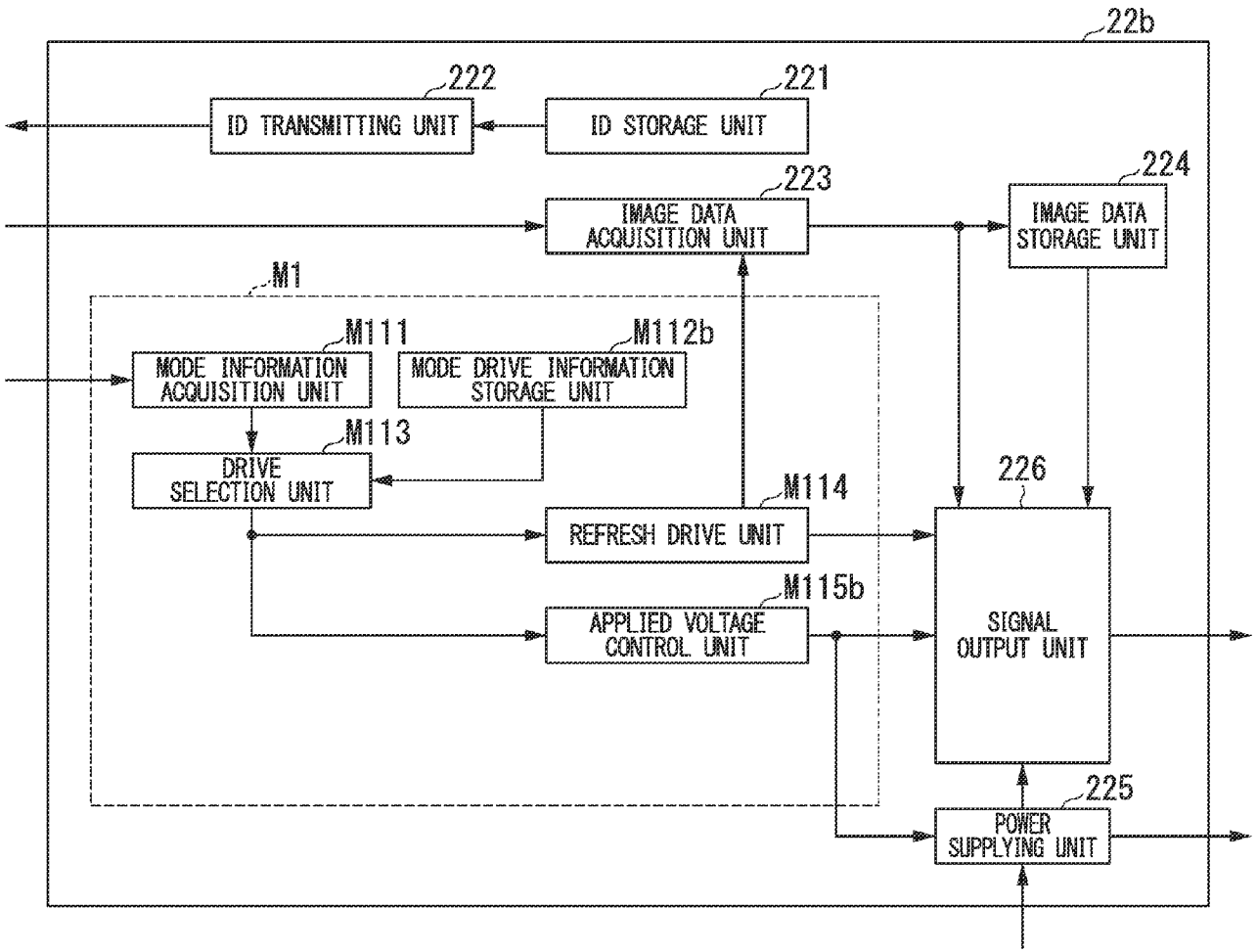
FIG. 21 is a simplified block diagram showing the logical constitution of a controller according to the present embodiment.

FIG. 21 is a simplified block diagram showing the logical constitution of the controller 22*b* according to the present embodiment. Comparing the controller 22*b* according to the present embodiment (FIG. 21) with the controller 22 of the first embodiment (FIG. 9), the mode drive information storage unit M112*b* and the applied voltage control unit M115*b* are different. However, the functions of other constituent elements are the same as in the first embodiment, and the description of the functions that are the same as in the first embodiment will be omitted.

The mode drive information storage unit M112*b*, in addition to the mode drive information (FIG. 10), stores beforehand the second mode drive information (FIG. 22). However, the present invention is not restricted to this, and the mode drive information storage unit M112*b* need not store the mode drive information (FIG. 10).

FIG. 22 is a simplified drawing showing an example of the second mode drive information according to the present embodiment. The second drive mode, the R frequency, and the applied voltage are associated with each other in the second mode drive information. Each of the items (R frequency and applied voltage) are the same as those shown in FIG. 10.

The applied voltage control unit M115*b*, in addition to the functions of the applied voltage control unit M115, has the function of reversing the polarity of the applied voltage. Specifically, the applied voltage control unit M115*b*, in accordance with the drive mode and applied voltage input from the drive selection unit M113, performs alternating current drive by controlling the signal output unit 226 and the power supplying unit 225.

In this manner, in the present embodiment, the signal drive mode is an alternating current drive scheme, in which the polarity of the voltages applied to the liquid crystal is changed in the time direction. Specifically, the second drive mode includes frame reversal drive and polarity reversal drive. The signal drive mode is a polarity reversal drive scheme in which the polarity of voltages applied to the liquid crystal is changed within the screen. Specifically, the second drive mode includes horizontal line reversal drive, vertical line reversal drive, dot reversal drive, and K dot reversal drive. By doing this, the display device D1 can flexibly control alternating current drive from the GPU 11*b* side and enables drive of the display panel 23 in an appropriate drive mode.

Variation Example

In FIG. 22, the value of at least two of the R frequencies R11 to R16 in the case of reversal drive 2 may be mutually different. That is, the controller 22*b* may change the R frequency in accordance with the alternating current drive scheme.

Figure 23:
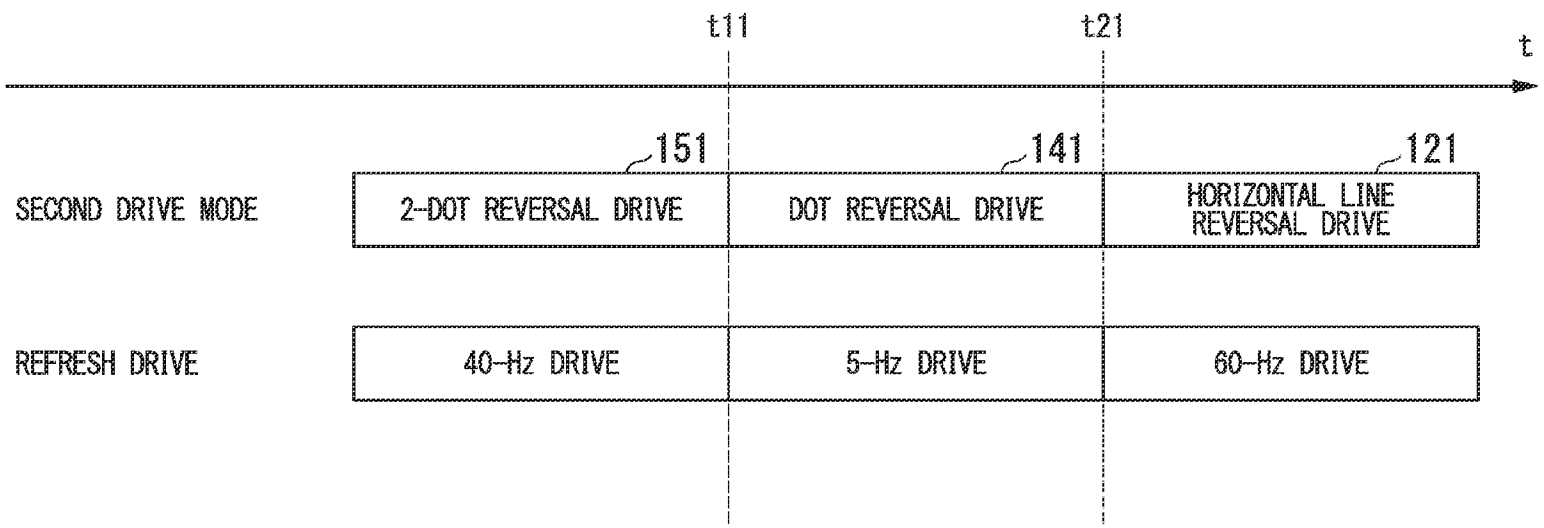
FIG. 23 is a simplified drawing showing a variation example of controller drive according to the present embodiment.

FIG. 23 is a simplified drawing showing a variation example of the drive by the controller 22*b* according to the present embodiment. This drawing shows that the controller 22*b* drives with an R frequency of 40 Hz when the second drive mode is 151 (2-dot reversal drive). This drawing also shows that the controller 22*b* drives with an R frequency of 5 Hz when the second drive mode is 141 (dot reversal drive) and drives with a R frequency of 60 Hz when the second drive mode is 121 (horizontal line reversal drive). That is, the larger is the number of continuous pixels with the same polarity (called the number of continuous same-polarity pixels, for example, the variable K or the number of pixels in the horizontal direction for the case of horizontal line reversal drive), the higher the R frequency is made, and the smaller the number of continuous same-polarity pixels is, the lower the R frequency is made. In this manner, in the case of the second drive mode, in which the number of continuous same-polarity pixels differs, the controller 22*b* may change the R frequency in accordance with the second drive mode.

If the number of continuous same-polarity pixels is small, the display image quality is improved, compared the case of a large number of continuous same-polarity pixels. Also, if the R frequency is high, the display image quality is improved, compared to the case of a low R frequency. In contrast, if the R frequency is low, the power consumption can be reduced, compared to the case of a high R frequency. In the present embodiment, when the number of continuous same-polarity pixels has become small, the display device D1 decreases the R frequency as well, thereby enabling an improvement of the display image quality. Also, when the number of continuous same-polarity pixels has become large, the display device D1 increases the R frequency as well, thereby enabling a reduction of the power consumption.

Fourth Embodiment

The fourth embodiment of the present invention will be described in detail below, with references being made to the drawings. In the present embodiment, the display device D1 (display control system) performs drive to increase or decrease the resolution (enlarge or reduce the image).

Specifically, the graphic chip 1 of FIG. 4 determines a third drive mode from among drive mode (third drive mode) candidates that convert the resolution. The graphic chip 1 transmits a mode command including the determined third drive mode to the liquid crystal module 2. The liquid crystal module 2 controls the supply of signals to the signal lines of the display panel 23, based on the third drive included in the mode command transmitted form the graphic chip 1.

The display device D1 according to the present embodiment replaces the GPU 11 of the display device D1 of the first, second, and third embodiments by a GPU 11*c*, and replaces a controller 22 with a controller 22*c*.

<Logical Constitution of the GPU 11*c*>

Figures 24, 25:
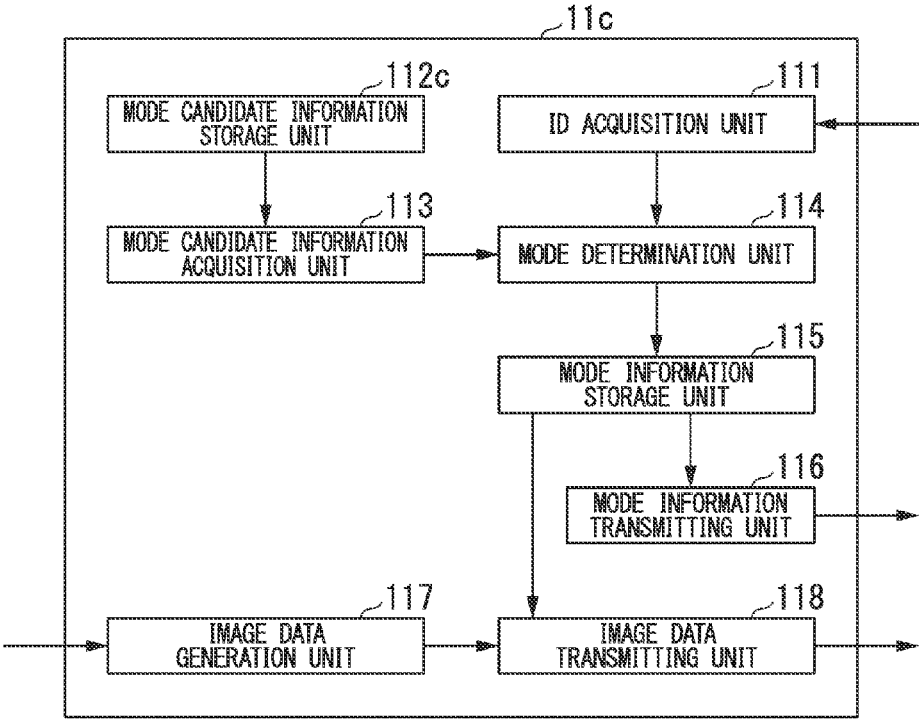
FIG. 24 is a simplified block diagram showing the logical constitution of a GPU according to a fourth embodiment of the present invention.
FIG. 25 is a simplified drawing showing an example of third mode candidate information according to the present embodiment.

FIG. 24 is a simplified block diagram showing the logical constitution of the GPU 11*c* according to the fourth embodiment of the present invention. Comparing the GPU 11*c* according to the present embodiment (FIG. 24) with the GPU 11 according to the first embodiment (FIG. 5), the mode candidate information storage unit 112*c* is different. However, the functions of other constituent elements are the same as in the first embodiment, and the description of the functions that are the same as in the first embodiment will be omitted.

The mode candidate information storage unit 112*c*, in addition to the mode candidate information (FIG. 6) or the second mode candidate information (FIG. 20), stores beforehand the third mode candidate information (FIG. 25) indicating third drive mode candidates. However, the present invention is not restricted to this, and the mode candidate information storage unit 112*c* need not store the mode candidate information (FIG. 6) or the second mode candidate information (FIG. 20).

FIG. 25 is a simplified drawing showing an example of third modes candidate information according to the present embodiment. In this drawing, the EDID, the third drive mode, and the variables are associated with each other in the mode candidate information.

(31) Normal Resolution Drive

Regarding normal resolution drive, the liquid crystal module 2 displays an image of image data transmitted from the graphic chip 1 at the same resolution as that image.

(32) Multiplied Resolution Drive

Regarding multiplied resolution drive, the liquid crystal module 2 displays an image of image data transmitted from the graphic chip 1 at a resolution of four times that of the image (doubled in the vertical direction and doubled in the horizontal direction, also called doubled-side display). For example, if the liquid crystal module 2 is to display an image having a number of pixels that is four times that of full Hi-Vision, the graphic chip 1 transmits a mode command including the full Hi-Vision image data and the drive mode 220 (multiplied resolution drive). This enables the liquid crystal module 2 to enlarge the image indicated by the full Hi-Vision image data four times and display the enlarged image.

(33) N-Multiplied Resolution Drive

Regarding N-multiplied resolution drive, the liquid crystal module 2 displays an image of image data transmitted from the graphic chip 1 at a resolution of 4×N times that of the image (for example, multiplied by 2×N in the vertical direction and multiplied by 2×N in the horizontal direction). FIG. 25 shows the specification of N as a variable in the case of N-multiplied resolution drive.

(34) Half-Resolution Drive

Regarding half-resolution drive, the liquid crystal module 2 displays an image of image data transmitted from the graphic chip 1 at a resolution of ¼ times that of the image (½ times in the vertical direction and ½ times in the horizontal direction).

(35) 1/N-Multiplied Resolution Drive

Regarding 1/N-multiplied resolution drive, the liquid crystal module 2 displays an image of the image data transmitted from the graphic chip 1 at a resolution of 1/(4×N) that of the image (1/(2×N) times in the vertical direction and 1/(2×N) times in the horizontal direction). FIG. 25 shows the specification of N as a variable in the case of 1/N-multiplied resolution drive.

<Logical Constitution of the Controller 22*c*>

Figure 26:
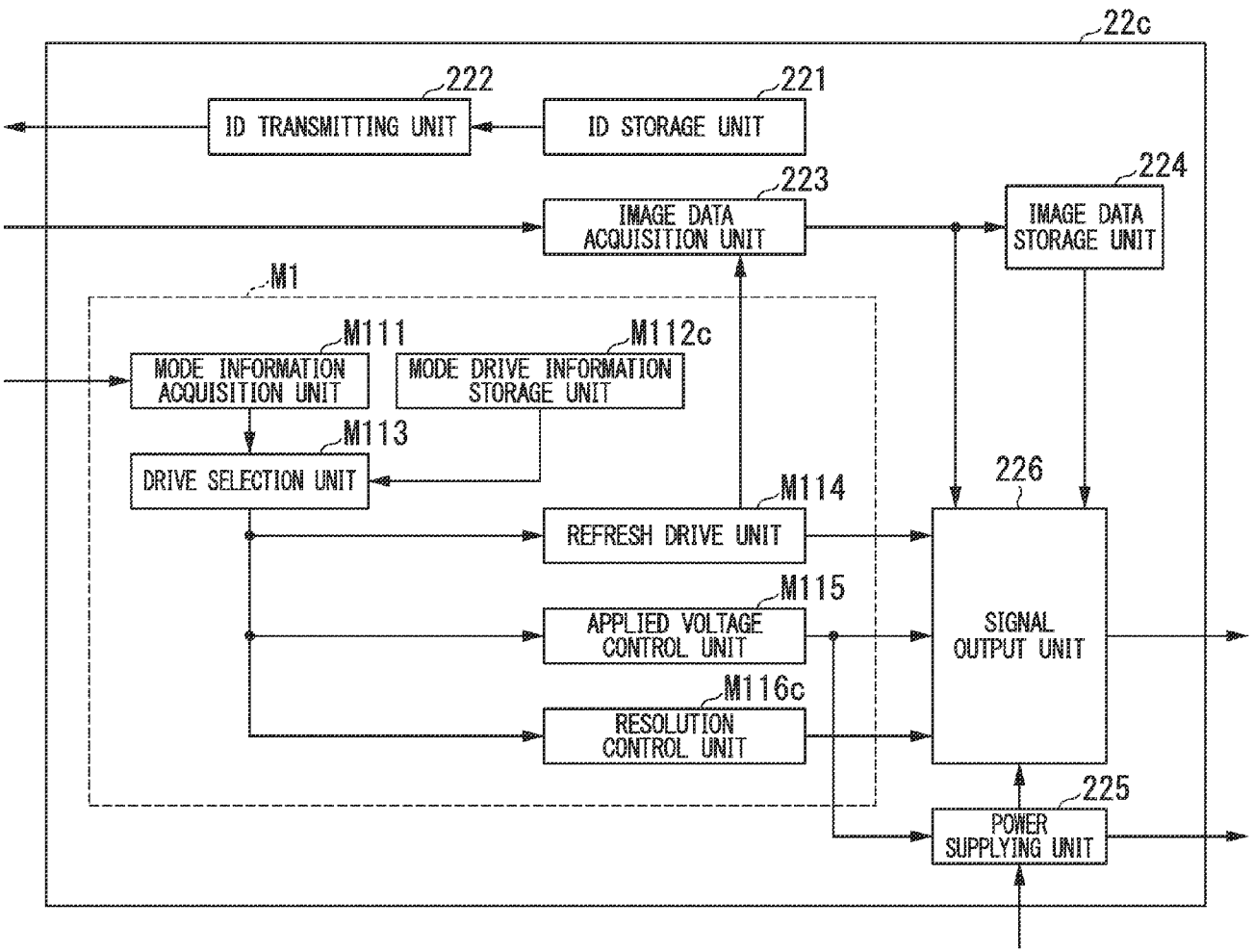
FIG. 26 is a simplified block diagram showing the logical constitution of a controller according to the present embodiment.

FIG. 26 is a simplified block diagram showing the logical constitution of the controller 22*c* according to the present embodiment. Comparing the controller 22*c* according to the present embodiment (FIG. 26) with the controller 22 according to the first embodiment (FIG. 9), the mode drive information storage unit M112*c* and the resolution control unit M116*c* are different. However, the functions of other constituent elements are the same as in the first embodiment, and the description of the functions that are the same as in the first embodiment will be omitted.

Figures 27, 28:
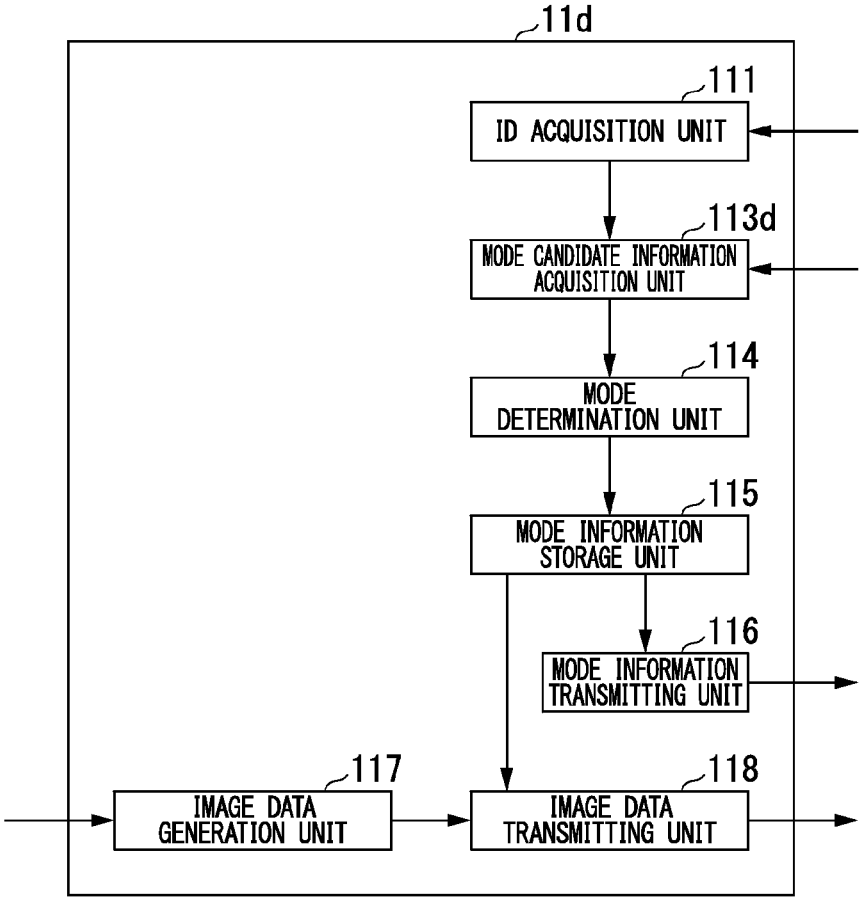
FIG. 27 is a simplified drawing showing an example of third mode drive information according to the present embodiment.
FIG. 28 is a simplified block diagram showing the logical constitution of a GPU according to a variation example of the various embodiments.

The mode drive information storage unit M112*c*, in addition to the mode drive information (FIG. 10) or the second mode drive information (FIG. 22), stores beforehand third mode drive information (FIG. 27). However, the present invention is not restricted to this, and the mode drive information storage unit M112*c* need not store the mode drive information (FIG. 10) or the second mode drive information (FIG. 22).

FIG. 27 is a simplified drawing showing an example of third mode drive information according to the embodiment. In this drawing, the third drive mode and change multiplier are associated with each other in the second mode drive information.

Returning to FIG. 26, the resolution control unit M116*c* controls to enlarge or reduce the resolution of the image of image data transmitted from the graphic chip 1.

In this manner, in the present embodiment at least one drive mode is a drive mode that changes the resolution of an image represented by image data. This enables the display device D1 to flexibly control resolution from the GPU 11*c* side, and enables drive of the display panel 23 in an appropriate drive mode.

(Variation Example of the Method of Acquiring Mode Candidate Information)

In the above-noted embodiments, the liquid crystal module 2 may transmit mode candidate information and the graphic chip 1 may receive the mode candidate information. The graphic chip 1 may determine the drive mode based on the mode candidate information received from the liquid crystal module 2. The display device D1 of the present variation example is constituted so that GPU 11*d* replaces the GPU 11 in the display device D1 according to the first embodiment.

FIG. 28 is a simplified block diagram showing the logical constitution of the GPU 11*d* according to the present embodiment. Comparing the GPU 11*d* of the present embodiment (FIG. 28) with the GPU 11 according to the first embodiment (FIG. 5), the mode candidate information acquisition unit 113*d* is different. However, the functions of other constituent elements are the same as in the first embodiment, and the description of the functions that are the same as in the first embodiment will be omitted.

The mode candidate information acquisition unit 113*d*, for example, uses the hot plug detect P11 to receive mode candidate information transmitted from the liquid crystal module 2 (for example, the ID transmitting unit 222). The mode candidate information may be only the case in which connection of hardware has been detected.

The above enables acquisition by the graphic chip 1 of mode candidate information from the liquid crystal module 2 even if, for example, a new liquid crystal module 2 is connected.

(Variation Example of the Information Included in the EDID)

The EDID may include identification information identifying the power consumption of the liquid crystal panel (for example, low-power panel, medium-power panel), identification information identifying the R frequency (for example, low-frequency panel, medium-frequency panel), or identification information identified by the forbidden band width (for example, IGZO). In this case, the mode determination unit 114 may select the mode candidate information of the liquid crystal module 2 based on this identification information.

(Variation Example of the Partial Drive Variables)

In the case of partial drive, the range of the R frequency that can be specified for each display region may be established. In this case, the ranges of R frequency that can be specified in at least two display regions may differ. For example, the R frequency may be specifiable from 5 Hz to 20 Hz in the display regions 1 and 3, and the R frequency may be specifiable from 5 Hz to 60 Hz in the display region 2. That is, the upper limit of the R frequency in the display region in the center part of the screen may be higher than the display region in the peripheral part of the screen. The lower limit of the R frequency in the display region in the center part of the screen may also be higher than the display region in the peripheral part of the screen. The display region in the center part of the screen is more likely to be focused on than the display region in the peripheral part of the screen. By setting the R frequency specification range as noted above in the display control system, the R frequency of a display region at the center part of the screen can be made higher than that of a display region in the peripheral part of the screen, enabling the setting of the R frequency to be made low in parts not focused on, while setting the R frequency in a part that is focused on to be high.

The graphic chip 1 and the liquid crystal module 2 may transmit and receive, for each display region, display region capacity information indicating the capacity of the display region (for example, information indicating the position or range of a display region or information indicating the range of R frequency that can be set in the display region).

FIG. 29 is a simplified drawing showing an example of display region capacity information according to a variation example of the above-noted embodiments. In this drawing, the display region identification information that identifies a display region, the display region information, and the R frequency range are associated with each other in the display region capacity information. In this case, the display region information indicates the position and range of the display region. The R frequency range indicates the range of R frequency that can be specified in the display region.

For example, FIG. 29 shows that the display region 3 having the display region identification information of 3 is from the A2 pixel to the A3 pixel on the display in the vertical direction and from the B2 pixel to the B3 pixel in the horizontal direction in the image. FIG. 29 also shows that the display region 3 can be driven at 30 Hz or greater and no greater than 60 Hz.

In the above-noted embodiments, although the description has been for the case in which the GPU 11 determines the drive mode, the present invention is not restricted to this, and the CPU D115 or both the CPU D115 and the GPU 11 may determine the drive mode.

In the above-noted embodiments, when the screen refreshing is stopped (stopped state), of the circuitry required to perform screen refresh, the operation of the digital circuitry included in the memory access circuit and drive circuit may be stopped, and the output from the analog circuitry included in the power supply circuit and drive circuit may be reduced. This enables a reduction of the power consumption of the display device when refreshing is stopped. The D/A conversion circuit and output buffer circuit of the analog circuitry included in the signal line drive circuitry may be operated by a smaller electrical power in the refresh stopped state than when refreshing is done. Also, the operation of the shift register circuit and the sampling latch circuit of the digital circuitry included in the signal line drive circuit may be stopped when the refreshing is stopped. This enables a reduction of the power consumption of the signal line drive circuit when the refreshing is stopped.

A part of the display control system in the above-described embodiments, for example, the display device D1, the video processing module 1, and the graphic chip 1 or the display module 2 and liquid crystal module 2 may be implemented by a computer. In this case, they may be implemented by recording a program for implementing the control functionality thereof into a computer-readable recording medium and by having a computer system read and execute the program recorded in the recording medium. The term "computer system" used here means computer system incorporated into the display control system, and includes an operating system and hardware such as peripheral devices. The term "computer-readable recording medium" refers to a removable medium such as a flexible disk, an optomagnetic disk, a ROM, a CD-ROM, or to a storage device such as a hard disk built into a computer system. Additionally, the term "computer-readable recording medium" may encompass one holding a program over a short time dynamically such as a communication line when a program is transmitted via a network such as the Internet or via a communication line such as a telephone line and one holding a program for a given period of time, such as a volatile memory within a computer system serving as a server or client. The above-noted program may be for implementing a part of the above-described functionality. Additionally, it may be one enabling implementation by combination with a program that already has recorded the above-noted functionality in a computer system.

A part or all of the display control system according to the above-described embodiments may implemented as an integrated circuit such as LSI (large-scale integration). Each of the functional blocks of the display control system may be implemented by a processor separately or a part or all thereof may be implemented in integrated fashion as a processor. The method of integrated circuit implementation is not restricted to LSI, and implementation may be done by dedicated circuitry or a general-purpose processor. Additionally, in the event of the appearance of integrated circuit implementation taking the place of LSI by advances in semiconductor technology, an integrated circuit using that technology may be used.

Although the foregoing has been a detail description of embodiments of the present invention, with references to the drawings, the specific constitution is not limited to the above, and may include various design modifications, within the scope of the spirit of the invention.

INDUSTRIAL APPLICABILITY

The present invention can be applied to a television device, a computer, a mobile telephone handset, a music player, a digital camera, a table terminal, or the like.

DESCRIPTION OF REFERENCE SYMBOLS

D1 Display device
1 Video processing module, Graphic chip
D111 Input unit
D112 Storage device
D113 Communication unit
D114 Memory
D115 CPU
11, 11*a*, 11*b*, 11*c*, 11*d* Processor, GPU
111 ID acquisition unit
112, 112*b*, 112*c* Mode candidate information storage unit
113, 113*d* Mode candidate information acquisition unit
114, 114*a* Mode determination unit
115 Mode information storage unit
116 Mode information transmitting unit
117 Image data generation unit
118 Image data transmitting unit
119*a* Judgment information acquisition unit
12 Interface, connector
2 Display module, liquid crystal module
21 Interface, connector
22, 22*b*, 22*c* Controller
221 ID storage unit
222 Display control
223 Image data acquisition unit
224 Image data storage unit
225 Power supplying unit
226 Signal output unit
M1 Mode control unit
M111 Mode information acquisition unit
M112, M112*b*, M112*c* Mode drive information storage unit
M113 Drive selection unit
M114 Refresh drive unit
M115, M115*b* Applied voltage control unit
M116*c* Resolution control unit
23 Display panel, liquid crystal panel
3, 3*a* Cable

The invention claimed is:

1. A display control system comprising a processor and a controller, wherein the processor comprises:

a scheme determination unit configured to determine a drive scheme from among candidates of a plurality of drive schemes having mutually differing schemes for supplying a signal to a signal line of a display unit; and a scheme information transmitting unit configured to transmit a scheme information indicating the drive scheme determined by the scheme determination unit, and wherein the controller comprises:

a scheme drive information storage unit configured to store a scheme drive information in which the scheme information and a signal control information in the drive scheme are associated with each other;

a scheme information acquisition unit configured to receive a the scheme information from the processor;

a signal control unit configured to control the signal supplied to the signal line of the display unit, the control being made based on the scheme information received by the scheme information acquisition unit and based on the scheme drive information:

an image data acquisition unit configured to acquire an image data from outside; and an image data storage unit configured to store at least one frame of the image data acquired by the image data acquisition unit, wherein the signal control unit is configured to control a first acquisition scheme that controls the signal supplied to the signal line of the display unit, based on an image data of a second frame acquired by the image data acquisition unit in the second frame that follows next after a first frame, or a second acquisition scheme that controls a signal supplied to the signal line of the display unit, based on an image data of the first frame stored by the image data storage unit, and wherein the scheme determination unit is configured to determine the drive scheme from among the candidates of the plurality of drive schemes candidates having mutually differing display refreshing frequencies in a case that the first acquisition scheme is selected.

2. The display control system according to claim 1, wherein at least two of the plurality of drive schemes mutually differ in a frequency of refreshing a display.

3. The display control system according to claim 1, wherein at least one of the plurality of drive schemes mutually differ in a frequency of refreshing a display in two display regions among a plurality of display regions.

4. The display control system according to claim 1, wherein at least two of the plurality of drive schemes mutually differ in a reference value of a voltage of the signal supplied to the signal line of the display unit.

5. The display control system according to claim 1, wherein the drive scheme is an alternating current drive scheme in which a polarity of a voltage applied to a liquid crystal is changed in a time direction.

6. The display control system according to claim 5, wherein the drive scheme is a polarity reversal drive scheme that changes the polarity of the voltage applied to the liquid crystal within a screen.

7. The display control system according claim 1, wherein the scheme determination unit is configured to a variable corresponding to the determined drive scheme determined by the scheme determination unit, and the scheme information transmitting unit is configured to transmit the scheme information indicating the drive scheme and the variable that are determined by the scheme determination unit.

8. The display control system according to claim 1, wherein the scheme determination unit is configured to determine the variable representing a frequency of refreshing a display.

9. The display control system according to claim 1, wherein the scheme information transmitting unit is configured to transmit the scheme information that includes a pre-established identification information, and wherein, upon detecting that the pre-established identification information is included in the scheme information received by the scheme information acquisition unit, the signal control unit is configured to control the signal supplied to the signal line of the display unit, based on the scheme information and the scheme drive information.

10. The display control system according to claim 9, wherein the pre-established identification information is an information included in an EDID (extended display identification data).

11. The display control system according to claim 1, wherein the processor and the controller is configured to use a main link that transfers an image data and an auxiliary channel having a slower transfer rate than that of the main link to perform communication, the scheme information transmitting unit is configured to transmit the scheme information using the auxiliary channel, and the scheme information acquisition unit is configured to receive the scheme information using the auxiliary channel.

12. The display control system according to claim 1, wherein the processor further comprises:

an image data generation unit configured to generate an image data, and wherein the scheme determination unit is configured to determine the drive scheme, based on the image data generated by the image data generation unit.

13. A controller comprising:

a scheme drive information storage unit configured to store a scheme drive information in which a plurality of drive schemes having mutually differing schemes of supplying a signal to a signal line of a display unit and a signal control information in a drive scheme in each of the plurality of drive schemes are associated with each other;

a scheme information acquisition unit configured to receive the scheme information indicating the drive scheme;

a signal control unit configured to control the signal supplied to the signal line of the display unit, based on the scheme information received by the scheme information acquisition unit and based on the scheme drive information;

an image data acquisition unit configured to acquire an image data from outside; and an image data storage unit configured to store at least one frame of the image data acquired by the image data acquisition unit, wherein the signal control unit is configured to control a first acquisition scheme that controls the signal supplied to the signal line of the display unit, based on an image data of a second frame acquired by the image data acquisition unit in the second frame that follows next after a first frame, or a second acquisition scheme that controls a signal supplied to the signal line of the display unit, based on an image data of the first frame stored by the image data storage unit.

* * * * *